US009324318B1

(12) United States Patent
Bunn et al.

(10) Patent No.: US 9,324,318 B1
(45) Date of Patent: Apr. 26, 2016

(54) CREATION AND APPLICATION OF AUDIO AVATARS FROM HUMAN VOICES

(71) Applicant: Nookster, Inc., Pasadena, CA (US)

(72) Inventors: Julian Bunn, Pasadena, CA (US); Yi Zheng, La Crescenta, CA (US); Nikhil R. Jain, Altadena, CA (US)

(73) Assignee: Nookster, Inc., Pasadena, CA (US)

( * ) Notice: Subject to any disclaimer, the term of this patent is extended or adjusted under 35 U.S.C. 154(b) by 32 days.

(21) Appl. No.: 14/514,272

(22) Filed: Oct. 14, 2014

(51) Int. Cl.
*G10L 13/033* (2013.01)

(52) U.S. Cl.
CPC ..... *G10L 13/033* (2013.01)

(58) Field of Classification Search
CPC ..... G10L 19/008; H04S 3/008; H04S 7/30; G06F 3/04842; G06F 3/0482
USPC ..... 704/233, 258, 264, 269, 271, 278; 235/487, 492; 725/81, 97
See application file for complete search history.

(56) References Cited

U.S. PATENT DOCUMENTS 6,607,136 B1 * 8/2003 Atsmon ..... G06F 21/34 235/487
8,806,544 B1 * 8/2014 Elliott ..... H04N 21/2387 725/81
8,949,123 B2 * 2/2015 Garg ..... G10L 13/033 704/233

* cited by examiner

*Primary Examiner* — Charlotte M Baker
(74) *Attorney, Agent, or Firm* — Fenwick & West LLP

(57) ABSTRACT

A subject voice is characterized and altered to mimic a target voice while maintaining the verbal message of the subject voice. Thus, the words and message are the same as in the original voice, but the voice that conveys the words and message in the altered voice is different. Audio signals corresponding to the altered voice are output, for example to an application for playback to a user, or to another application or device for subsequent playback by the user or someone else. In one embodiment, the altered voice is posted to a social network. In other embodiments, the altered voice is used by other software applications or consumer electronics applications, such as GPS guidance systems, ebook readers, voice-based intelligent personal assistants, chat applications, and/or others that use voice as an input or output.

19 Claims, 24 Drawing Sheets

CREATION AND APPLICATION OF AUDIO AVATARS FROM HUMAN VOICES

BACKGROUND

1. Field of Disclosure

This disclosure relates generally to mimicking a target human voice and more particularly to consumer electronics applications that use voice inputs and/or outputs.

2. Description of the Related Art

Small form factor electronic devices, such as smartphones, smartwatches and other wearable devices, often lack full keyboards and frequently have a limited screen size. Accordingly, conventional user interfaces that rely on text or touch input can be difficult to implement on these devices. Such devices are increasingly relying on voice inputs and voice outputs to interface with users.

With the increased emphasis on voice as a user interface, some companies have added voice-altering capabilities to their products for entertainment purposes. Such voice altering capabilities include changing the speed of the voice by slowing down or speeding up the rate of playback of an audio file containing the voice, and changing the frequency of the voice so that the voice sounds higher or lower than the original.

SUMMARY

Embodiments of the invention characterize a subject voice and alter the subject voice to sound like a target voice. A subject voice is received as input. For example, a user records her own voice speaking a message of her choice. A sample of a target voice is also received as input. A voice analysis and altering module characterizes the subject voice and the sample of the target voice, and then alters the subject voice to mimic the target voice while maintaining the verbal message of the subject voice. Thus, the words and message are the same as in the original recording, but the voice that conveys the words and message is different. Audio signals corresponding to the altered voice are output, for example to an application for playback to a user, or to another application or device for subsequent playback by the user or someone else.

In one embodiment, a file comprising the output audio signal is posted to a social network. In one implementation, the social network is an anonymous social network. Other users can retrieve the posted voice file for playback, but they will not be able to identify the user's voice in real-life from the altered voice without access to the subject voice and target voice. In other embodiments, the output audio signal is used by other software applications or consumer electronics applications, such as global positioning system (GPS) guidance application, ebook readers, voice-based intelligent personal assistants, chat applications, and/or others that use synthetic or natural voice as an input or output or both. The ability to transform one voice to mimic another voice can be used for enhancing user experience/engagement, for entertaining purposes, for adding anonymity, or for enabling users to better express their authentic selves without being confined to the voice that their biology dictates.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIGS.) and the following description describe certain embodiments by way of illustration only. One skilled in the art will readily recognize from the following description that alternative embodiments of the structures and methods illustrated herein may be employed without departing from the principles described herein.

DETAILED DESCRIPTION

Embodiments of the invention alter a subject voice to mimic a target voice. In one embodiment, the subject voice is changed through an audio signal processing technique to mimic a target voice of a user's choice, referred to herein as an audio avatar. For ease of explanation, embodiments of the invention are described below in the context of an audio file, for example a voice message. However, it is noted that the audio file can also be streamed audio, an audio recording, or audio track of a video.

System Architecture

Figure 1:
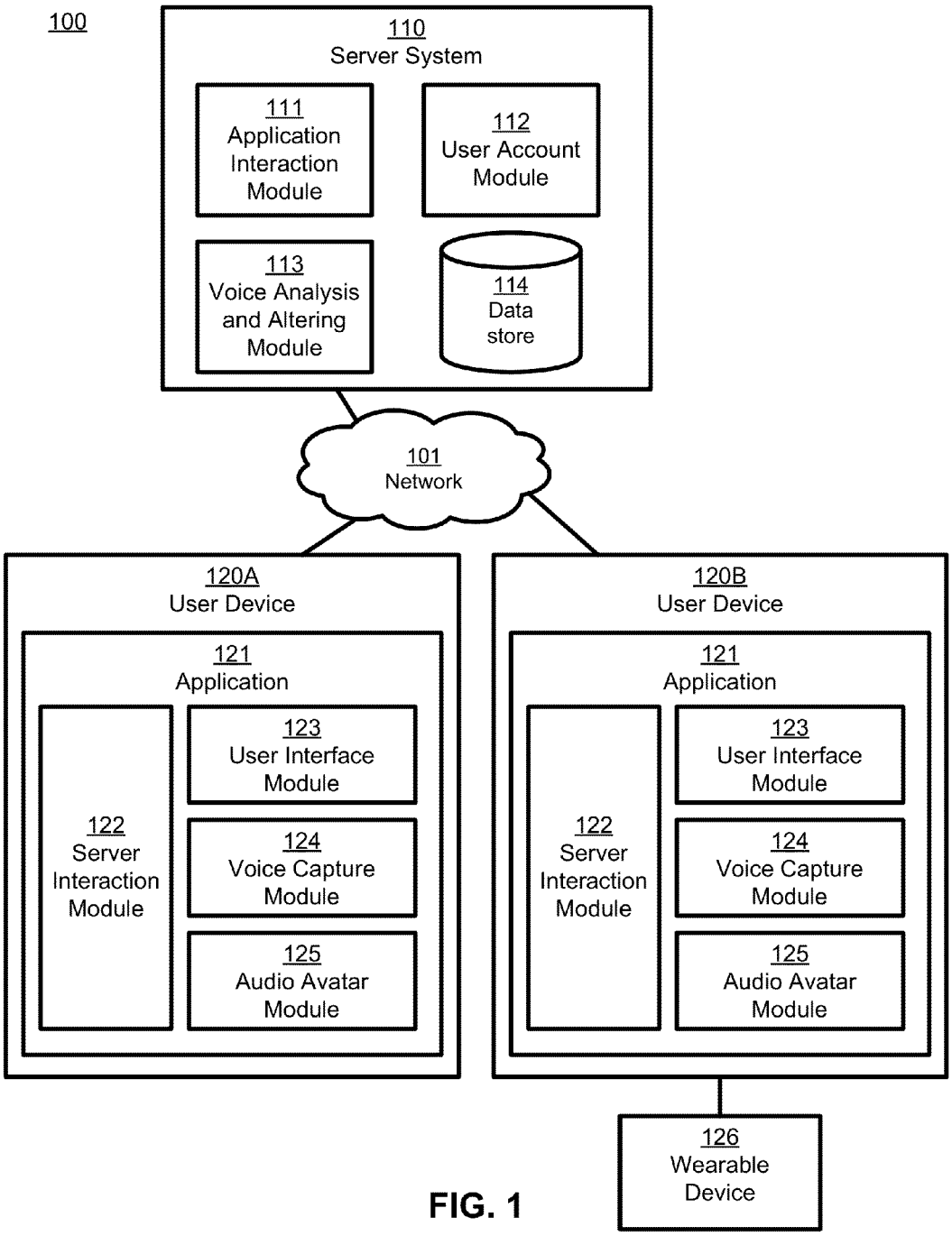
FIG. 1 is a high-level block diagram illustrating an embodiment of a computing environment for the creation and application of audio avatars from human voices.

FIG. 1 is a high-level block diagram illustrating an embodiment of a computing environment for the creation and application of audio avatars from human voices. The platform environment 100 includes a server system 110 and user devices 120A, 120B (collectively 120) connected by a network 101. Only one server system 110 and two instances of user devices 120 are illustrated, but in practice there may be more instances of each of these entities. For example, there may be thousands or millions of user devices 120 in communication with several server systems 110.

The server system 110 authenticates user devices 120, analyzes and alters voices captured in audio samples by those user devices 120 or other captured voices, and outputs digital audio signals corresponding to the altered voices. The server system 110 further stores user data, including account information and may store past samples. In some embodiments, the server system 110 is implemented as a single server, while in other embodiments it is implemented as a distributed system of multiple servers. The server system 110 includes an application interaction module 111, a user account module 112, a voice analysis and altering module 113, and a data store 114.

The application interaction module 111 manages the interactions between the server system 110 and the user devices 120. Specifically, the application interaction module 111 receives voices from the user devices 120 and sends altered voices to user devices 120 for playback. In one embodiment, the application interaction module 111 also communicates the selection of an audio avatar by a user from the user device 120 to the server system and the selection of user preferences, user credentials, account information, or other commands related to functions managed by the server system 110.

The user account module 112 receives user credentials, for example from the application interaction module 111 to authenticate a user operating a user device 120 to the server system 110 and enable access to the user's stored data. The user account module 112 may also store user preferences, user profile information, and other administrative data for each respective account into data store 114.

The voice analysis and altering module 113 receives source voices in audio files including voice audio signals, for example from streamed audio, from an audio recording, or from the audio track of a video. The source voices include subject voices that users want to alter and target voices that users want to use as audio avatars. In one embodiment, the source voices are from a user using a user device 120 or from the data store 114. In one embodiment, the voice analysis and altering module 113 characterizes the subject voice, alters the subject voice to mimic a selected target voice, and outputs digital audio signals corresponding to the altered voice. In another embodiment, the voice analysis and altering module 113 converts text input into a natural or synthesized voice. The voice analysis and altering module 113 is further described with reference to the block diagram of FIG. 2 and the flowcharts of FIGS. 4-6 below.

The data store 114 of the server system 110 stores user data for access by the server system 110, and in some cases for distribution to user devices 120. The user data may be, for example, data collected by the user account module 112, such as user preferences, user profile information, and other administrative data for each respective account, as well as the user's voice patterns characterized by the voice analysis and altering module 113 and previous voice samples and the respective audio avatars chosen. The data store 114 may further store audio avatars corresponding to other source voices that have been characterized. These audio avatars in data store 114 can be included among the choices from which a user may select a target voice. In some embodiments, the data store 114 is a distributed data store, and in some embodiments, some of the data described as stored in data store 114 as part of the server system 110 can be alternatively or additionally stored on a user device 120.

The user device 120A is a computing device, such as a desktop, laptop, or tablet computer, or a smart phone or other mobile computing device. The user device 120A is used to record voices, make audio avatar selections, and listen to altered voices. The user device 120A executes an application 121.

The application 121 is a software application, for example running within the operating system of the user device 120. The software application contains program modules to implement the voice-altering functionality described herein. In one particular embodiment, the software application implements the functionality of voice-based anonymous social network, including posting audio messages, listening to messages, and responding to messages of other users of the social network by posting text, audio, or video comments. In other embodiments, the software application is a GPS guidance application, an ebook reader, a voice-based intelligent personal assistant, a voice-based chat application, and/or other application that uses voice as an input or output. In one embodiment, the application 121 is used to modify a synthetic or natural voice to sound like a target voice. Specifically, as illustrated in this example, the application 121 includes a server interaction module 122; a user interface module 123, a voice capture module 124, and an audio avatar module 125.

The server interaction module 122 of the application 121A manages the interactions of the application 121 with the server system 110. The server interaction module 122 communicates data between the user device 120 and the server system 110 via the network 101. The server interaction module 122 relays to the server system 110 subject voices and selections of audio avatars, and the server interaction module 122 relays from the server system 110 altered voices.

In situations in which the systems discussed here collect personal information about users, or may make use of personal information, the users may be provided with an opportunity to control whether programs or features collect user information (e.g., information about social actions or activities, profession, a user's preferences, or a user's current location), or to control whether and/or how to receive content from the server system 110 that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by the server system 110.

The user interface module 123 presents the user interface of the software application 121 to the user and receives the user's input through the user device 120, such as through a touchscreen of the user device 120 displaying a graphical user interface. Examples of a user interface of the application 121 implemented as an anonymous social networking application will be described below with reference to FIGS. 7-23.

The voice capture module 124 uses a microphone or a camera and microphone combination of the user device 120 to capture a voice. The voice capture module 124 may optionally format, compress, or otherwise prepare the audio file for transmission to the server system 110 via the network 101, according to any technique known to those of skill in the art.

The audio avatar module 125 receives a user's selection of a target voice. In one embodiment, the audio avatar module 125 presents an array of audio avatars for possible selection by the user (for example, from local storage on the device 120 or from data store 114), receives the user's selection of an audio avatar to apply to a subject voice, and in one embodiment, conveys the selected audio avatar to the server interaction module 122 for communication to the server system. In an alternative embodiment, the audio avatar module 125 may perform the audio signal processing described below as with reference to the voice analysis and altering module 113 of the server system 113 in order to perform the voice altering on the user device 120.

The user device 120B is a computing device, such as a smartphone or other mobile computing device connected to a wearable electronic device 126, such as a smartwatch or glasses. The wearable device 126 can be used to perform many of the functions described above, such as recording a voice, selecting an audio avatar, and playing back altered voices. In an alternative embodiment, the wearable device 126 may also perform the audio signal processing described below as with reference to the voice analysis and altering module 113 of the server system 113 in order to apply the audio avatar to the subject voice. The wearable device 126 may communicate with the user device 120B according to any protocol known to those of skill in the art.

The network 101 provides a communication infrastructure between the server system 110 and the client devices 120. The network 101 is typically the Internet, but may be any network, including but not limited to a Local Area Network (LAN), a Metropolitan Area Network (MAN), a Wide Area Network (WAN), a mobile wired or wireless network, a private network, or a virtual private network.

Figure 2:
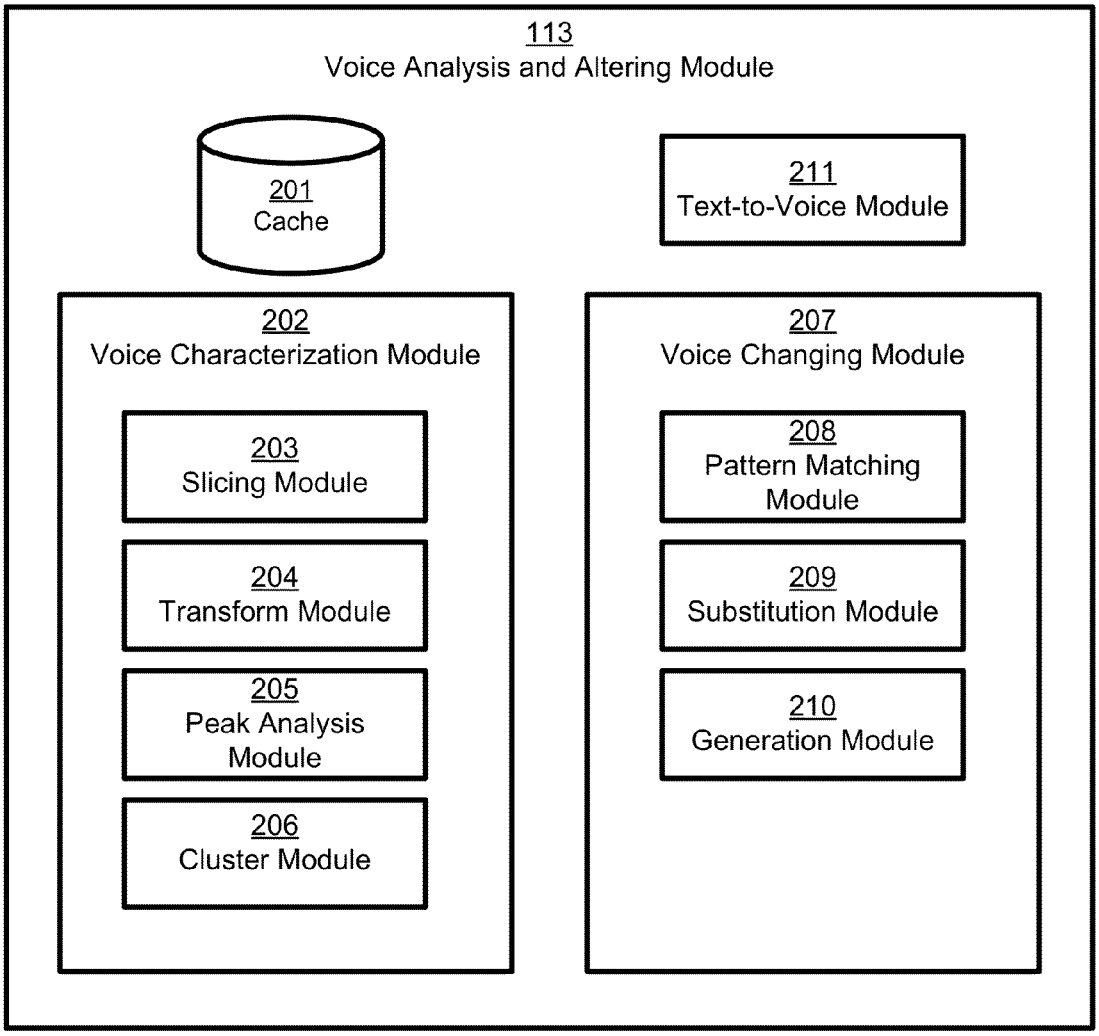
FIG. 2 is a block diagram illustrating a voice analysis and altering module, in accordance with an embodiment.

FIG. 2 is a block diagram illustrating a voice analysis and altering module 113 of the server system 110 described above, in accordance with an embodiment. The voice analysis and altering module 113 includes a cache 201, a voice characterization module 202, a voice changing module 207, and optionally a text-to-voice module 211.

The cache 201 temporarily stores a voice to be analyzed and altered by module 113 for operational convenience. The cache 201 may also temporarily store altered voices or slices of it after it has been processed by the voice analysis and altering module 113, before it is stored in data store 114.

The voice characterization module 202 characterizes source voices from voice samples. The voice sample may be a subject voice that a user desires to alter, or the voice sample may be a sample of a target voice selected to be mimicked. The voice characterization module 202 includes a slicing module 203, a transform module 204, a peak analysis module 205, and a cluster module 206.

The slicing module 203 slices the audio file containing a voice to be characterized into short periods of a few to tens of milliseconds. Each slice may overlap the previous slice. Some overlap of slices, for example half of the slice period, is preferred to maximize the fidelity of the processed audio, however no overlap is required. Regarding slice length, if the slices are too long, then more than one sound will be captured in a slice, and if the slice is too short, then the entirety of one sound is not captured. In both of these cases, the quality of the audio processing will be diminished.

The transform module 204 extracts the frequency content of each slice. For example, the transform module can apply a Fast Fourier Transform to each slice. Alternatively, a filter bank of tuned filters can be used to extract the intensity of each slice at each of the filter center frequencies. This yields the frequency content of each slice. The transform module 204 outputs the normalized levels for all frequencies in the slice.

The peak analysis module 205 extracts the N most significant frequency peaks, determined by the size of the peak, for each slice. In one embodiment, the peak search is only performed within the frequency range of human voice, so that the dominant frequencies present in the slice are more likely to correspond to human voice than to background noise. In one embodiment, N is selected to be a value between 10 and 15, but higher or lower values of N can be used. The larger N is, the more likely that at least some of the peaks correspond to noise. The lower the value of N, the less fidelity to the original voice signals. The peak analysis module 205 stores N descriptions of frequency, intensity, and phase values for the N most significant frequency peaks for the slice, which is referred to herein as the slice pattern.

The cluster module 206 clusters slices together according to slice patterns, for example using k-means clustering or x-means clustering or any other clustering or classification algorithm known to those of skill in the art. The clustering results in a set of M slice patterns that correspond to the fundamental sounds present in the audio file. The number M of clustered slice patterns is chosen to optimize the fidelity of the representation, and minimize the amount of data that needs to be stored. There is a tradeoff between optimizing the fidelity and minimizing the amount of data. In one embodiment, M is on the order of 100, whereas M being on the order of 10 is too few, and M being on the order of 1000 is unnecessarily detailed. M can be thought of as the number of distinct or atomic sounds that a given voice makes. This set of M slice patterns is referred to herein as the voice pattern for a characterized voice.

The voice changing module 207 takes as input the slice pattern of the subject from the peak analysis module 205 and the voice patterns of the target that have been output from the voice characterization module 202. The voice changing module 207 alters the voice from an audio file of a subject to sound like a target voice. The voice changing module 207 includes a pattern matching module 208, a substitution module 209, and a generation module 210.

The pattern matching module 208 matches each slice pattern from the set of M slice patterns from the subject to the closest voice pattern from the target. One example of an algorithm to perform this matching begins with normalizing the subject's pattern and the target's pattern, for example by setting the first frequency f(1) to 1, and the remaining frequencies expressed as a multiple of the first frequency, f(1). So, if the pattern is (1000 Hz, 1.0) and the second is (1200 Hz, 0.5), then the normalized values are (1.0, 1.0) and (1.2, 0.5). After all of the frequencies have been normalized, the pair of patterns is examined term by term, and the root mean square (RMS) difference between the (a) frequencies and (b) intensities are computed. The distance between the two patterns is then calculated as the root mean square frequency difference multiplied by the root mean square intensity difference. Of course, for two identical patterns, the difference calculated will be zero. The closest match corresponds to the minimum calculated distance.

The substitution module 209 replaces each slice pattern from the subject with the matching voice pattern from the target. The resulting set of slice patterns can be saved temporarily to the cache 201.

The generation module 210 generates a superposition of sine waves in the time domain over the period of the slice according to the target voice pattern substituted for the subject's slice pattern, which can then be output as digital audio signals corresponding to the altered voice.

The text-to-voice module 211 is optionally present in the voice analysis and altering module 113 or on a user device 120. The text-to-voice module 211 takes any input text (i.e., any text word, phrase, command, sentence, message, email, or any other text content) and converts it to voice output (i.e., audio signals corresponding to the input text read aloud in a natural human voice or synthetic voice) according to any technique known to those of skill in the art. The voice output from the text-to-voice module 211 can then be used as the subject to be altered using an audio avatar. Accordingly, in some embodiments of the invention, by applying an audio avatar to text messages such as instant messages and TWEETS, input text messages can be made audible in a voice of a user's choice.

Figure 3:
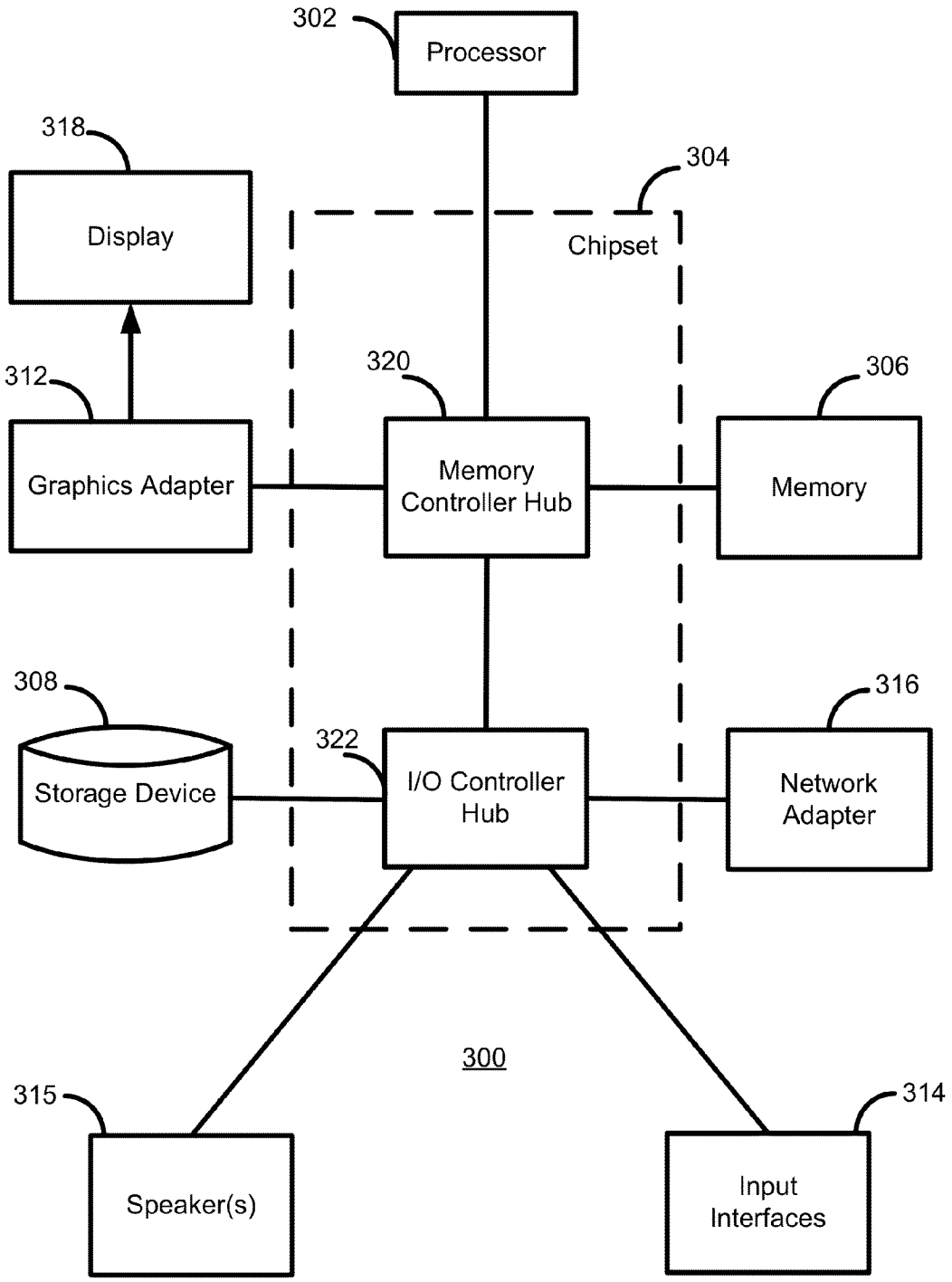
FIG. 3 is a high-level block diagram illustrating an example computer for implementing the entities shown in FIG. 1.

FIG. 3 is a high-level block diagram illustrating an example computer 300 for implementing one or more of the entities shown in FIG. 1, such as the server system 110, user device 120, or wearable device 126. The computer 300 includes at least one processor 302 coupled to a chipset 304. The chipset 304 includes a memory controller hub 320 and an input/output (I/O) controller hub 322. A memory 306 and a graphics adapter 312 are coupled to the memory controller hub 320, and a display 318 is coupled to the graphics adapter 312. A storage device 308, input interfaces 314, speaker(s) 315, and network adapter 316 are coupled to the I/O controller hub 322. Other embodiments of the computer 300 have different architectures.

The storage device 308 is a non-transitory computer-readable storage medium such as a hard drive, compact disk read-only memory (CD-ROM), DVD, or a solid-state memory device. The memory 306 holds instructions and data used by the processor 302. The input interfaces 314 may include a touch-screen interface, a mouse, track ball, or other type of pointing device, a keyboard, a microphone, a camera, or some combination thereof, and is used to input data into the computer 300. In some embodiments, the computer 300 may be configured to receive input (e.g., commands) from the input interface 314 via gestures from the user. Gestures are movements made by the user while contacting a touch-screen interface. For example, tapping a portion of the screen, touching a portion of the screen and then dragging the touched portion in a particular direction, etc. The computer 300 monitors gestures made by the user and converts them into commands (e.g., dismiss, maximize, scroll, etc.) In other embodiments, the computer 300 may be configured to receive input such as audio signals or subject voice audio files from a microphone or camera and microphone combination. The computer 300 may also include one or more speakers 315 to playback audio. The graphics adapter 312 displays images and other information on the display 318. The network adapter 316 couples the computer 300 to one or more computer networks, such as network 101.

The computer 300 is adapted to execute computer program modules for providing functionality described herein. As used herein, the term "module" refers to computer program logic used to provide the specified functionality. Thus, a module can be implemented in hardware, firmware, and/or software. In one embodiment, program modules are stored on the storage device 308, loaded into the memory 306, and executed by the processor 302.

The types of computer 300 used by the entities of FIG. 1 can vary depending upon the embodiment and the processing power required by the entity. For example, the server system 110 may include multiple computers 300 communicating with each other through a network to provide the functionality described herein. Such computers 300 may lack some of the components described above, such as graphics adapters 312, displays 318, speakers 315, and may also lack some types of input interfaces 314.

Example Methods

Figure 4:
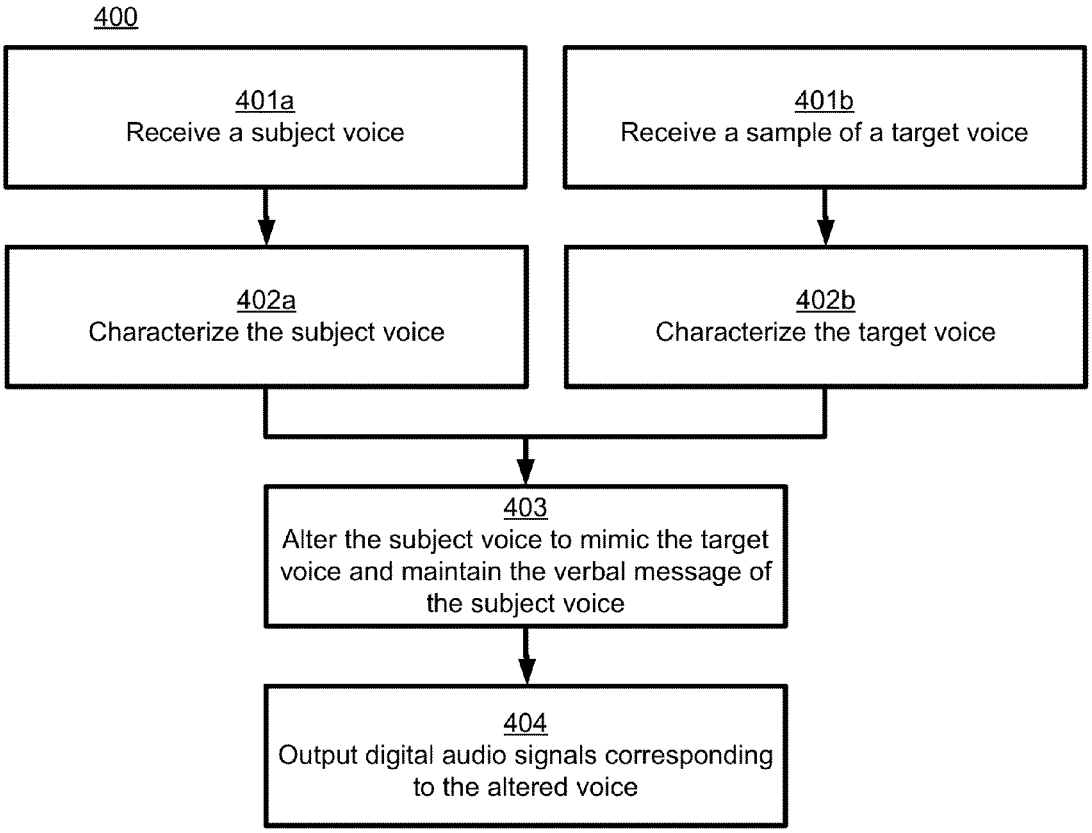
FIG. 4 is a flowchart illustrating a method of mimicking a target voice, in accordance with an embodiment.

FIG. 4 is a flowchart illustrating a method 400 of mimicking a target voice, in accordance with an embodiment. In step 401*a*, a subject voice is received. The subject voice includes a verbal message, such as a greeting, commentary on a topic, etc. The subject voice is the voice to be characterized and altered. The subject voice may be a recorded speech, a scripted spoken message, a monologue, spoken commentary, machine voice such as the output of a text-to-voice module 211, etc. The subject voice may be a human voice or a synthetic voice generated by a computer. In step 401*b*, a sample of a target voice is received. The sample of the target voice is the voice to be mimicked.

In step 402*a*, the subject voice is characterized. Likewise, in step 402*b*, the target voice is characterized based on the sample of the target voice. An example process for characterizing a voice is described below in detail with reference to the flowchart of FIG. 5.

In step 403, the subject voice is altered to mimic the target voice while maintaining the verbal message of the subject voice. An example process for altering a subject voice to mimic a target voice is described below in detail with reference to the flowchart of FIG. 6.

In step 404, the digital audio signals corresponding to the altered voice are output. For example, the altered voice may be output to an audio file that is posted to a social network so that other users of the social network may access it and play it back on their user devices 120. In one particular implementation, the users of the social network are not able to identify the individual who contributed the post to the social network without access to the subject voice and target voice. Thus, in this implementation, the contributor can remain anonymous because the contributor's voice has been disguised to sound like the voice of an audio avatar. Thus, even the person's real-life friends and family who are quite familiar with the person's regular voice will not be able to identify the person by the altered voice that is posted to the social network. Optionally, in response to the posted file, comments may be received from other users of the social network. Examples of comments include text, audio files, and video files. If the comment includes a voice, steps 401-404 can be repeated to alter the voice present in the comment to protect the anonymity of the contributor of the comment. Thus, in this implementation, the anonymous social network allows online discussions through message threads about whatever is on users' minds, by harnessing the convenience of voice contributions without compromising the user's anonymity. The use of audio avatars allows users of the social network to express themselves in whatever voice they choose, regardless of their normal speaking voice.

In other embodiments, the altered voice may be output to other software applications or electronic devices in order to apply an audio avatar to the default voice of the software application or electronic device. For example, the altered voice may be output to a GPS guidance application so that directions are delivered in the voice an audio avatar, such as in the user's own voice, rather than in the default voice. As another example, the altered voice may be output to an ebook reader so that a story read aloud by the ebook reader can be read aloud in the voice of a loved one, such as a child's parent, rather than in a default voice. As another example, the altered voice may be output to a voice-based intelligent personal assistant so that the intelligent personal assistant speaks in a target voice of a user's choice. Similarly, the altered voice may be communicated to any consumer application, such as a chat application that sends peer-to-peer communications or peer-to-group communications, for example for entertainment purposes. The altered voice can be output to any application that uses voice as an input and/or output. The ability to transform one voice to mimic another voice can be used for enhancing user experience/engagement, for entertaining purposes, for adding anonymity, or for enabling users to better express their authentic selves without being confined to the voice that their biology dictates.

In another example embodiment, the method of FIG. 4 can be used for the creation and application of audio avatars from human voices as follows. To create an audio avatar, in step 401*b*, the sample of the target voice is captured by a user device 120. For example, a user speaks into a microphone of the user device to capture his own voice, or records his friend's voice on the user device 120. In step 401*b*, the sample of the target voice is characterized. Once captured and characterized, the target voice can be made into an audio avatar to apply to any voice in the future. In fact, the sample of the target voice may be captured just once, while the audio avatar of the voice can be applied many times to many different subject voices in the future. Thus, in one embodiment, step 401*b* and 402*b* may be executed far in advance of step 401*a* and 402*a* which refer to receiving the subject voice and characterizing the subject voice.

In this example, after steps 401*b* and 402*b* have been completed, in step 401*a*, a subject voice is received, for example from any other electronic device or application through an application programming interface (API), or from a text-to-voice module 211 creating the sample. In step 401*b*, the subject voice is characterized as described above. Optionally, a selection of an audio avatar to apply to the subject voice is also received, before, concurrently with, or after the receipt of the subject voice. The selection of the audio avatar may be communicated through the API.

Then, steps 403 and 404 may execute substantially as described in the examples above and below, in order to alter the subject voice to mimic the target voice and maintain the verbal message of the subject voice. However, in step 404, the digital audio signals can be output to any software application or electronic device capable of outputting the digital audio signals, for example through an API to the software application or electronic device to replace the default voice of that software application or electronic device. Thus, the user can enjoy hearing voice communications from the software application or electronic device in the target voice of his choice (e.g., the audio avatar corresponding to his own voice, another audio avatar he has created, or an audio avatar created by someone else and shared through the server system 110) rather than a default voice or no voice at all. In addition, through the user creating and applying audio avatars, user metadata is captured to further enhance the user profile stored, for example, by a user account module 112.

Figure 5:
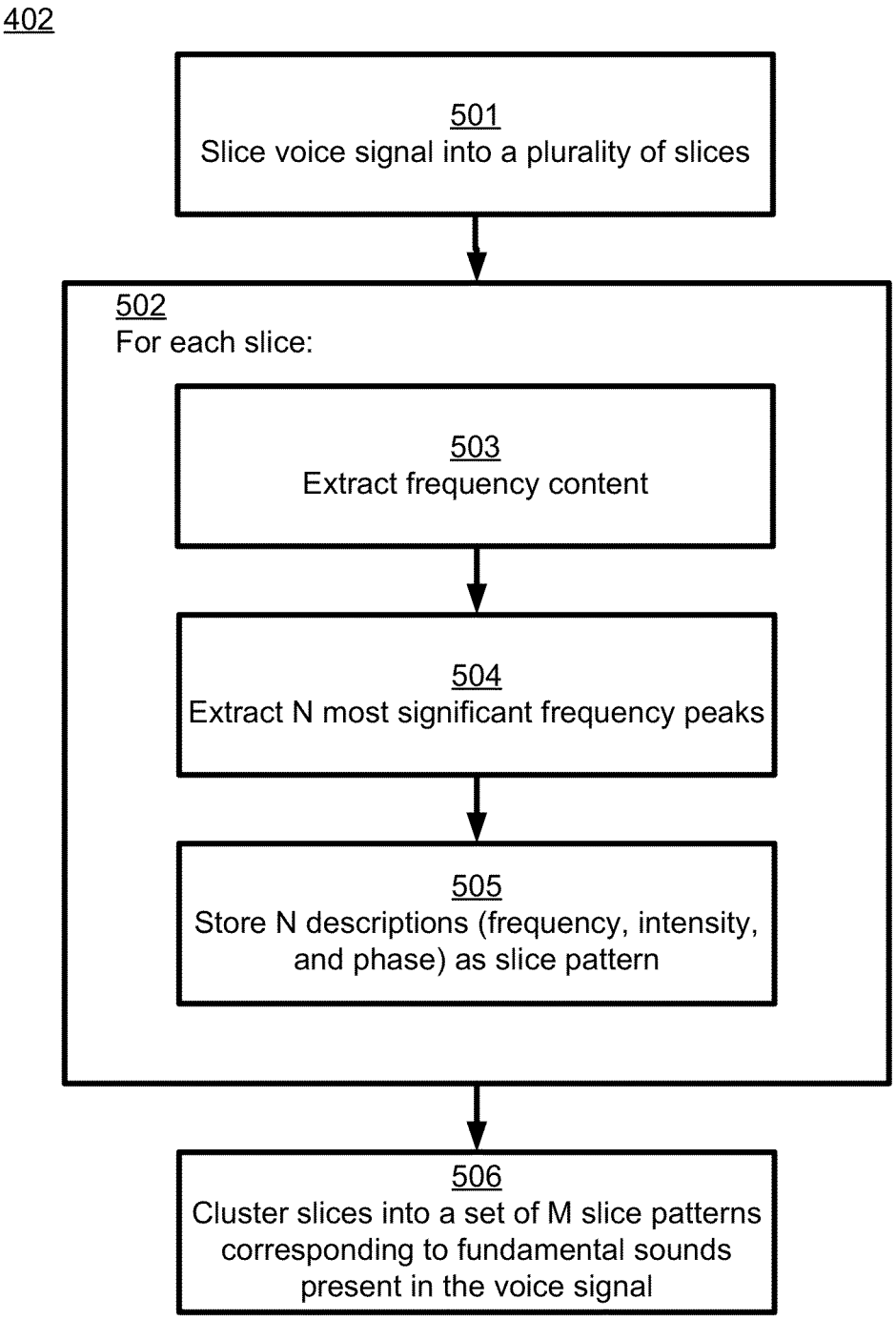
FIG. 5 is a flowchart illustrating a method of characterizing a voice, in accordance with an embodiment.

FIG. 5 is a flowchart illustrating a method 402 of characterizing a voice, in accordance with an embodiment. The method 402 can be used in the context of the method described above with reference to FIG. 4, or the method may be used as a stand-alone method of voice compression, by reducing the complexity of a recorded voice to a set of characteristic slice patterns present in the voice. The method 402 can be used to characterize a subject voice that the user wants to have altered, or it can be used to characterize a target voice for use as an audio avatar.

In step 501, the voice signal is sliced into a plurality of slices, for example by a slicing module 203 of the voice characterization module 202 of the voice analysis and altering module 113. As described above, each slice is a short period which ranges from a few to tens of milliseconds, and each slice may overlap the previous slice.

In step 502, each slice is analyzed separately either in series or parallel, for example by the voice characterization module 202. In step 503, the frequency content of the slice is extracted. For example, a Fast Fourier Transform is performed on the slice, for example by the transform module 204 of the voice characterization module 202. Alternatively, a filter bank of tuned filters can be used the extract the intensity of each slice at each of the filter center frequencies. In step 504, the N most significant frequency peaks determined by the intensity levels of the peaks are extracted, for example by the peak analysis module 205 of the voice characterization module 202. Then, in step 505, the N descriptions (frequency, intensity, and phase) corresponding to the N most significant frequency peaks are stored as the slice pattern. The voice characterization module 202 iterates steps 503-505 over each slice of the voice signal to accumulate a large number of slice patterns.

In step 506, the slices are clustered according to the slice patterns into a set of M slice patterns, where each slice pattern in the set of M slice patterns corresponds to a fundamental sounds present in the voice signal. The clustering is performed, for example, by a cluster module 206 executing a clustering algorithm such as k-means clustering or x-means clustering or any other clustering or classification algorithm known to those of skill in the art. In this case, M represents a reduced set of patterns from a great number of N descriptions from the slice patterns. This set of M slice patterns is the voice pattern for the characterized voice.

Figure 6:
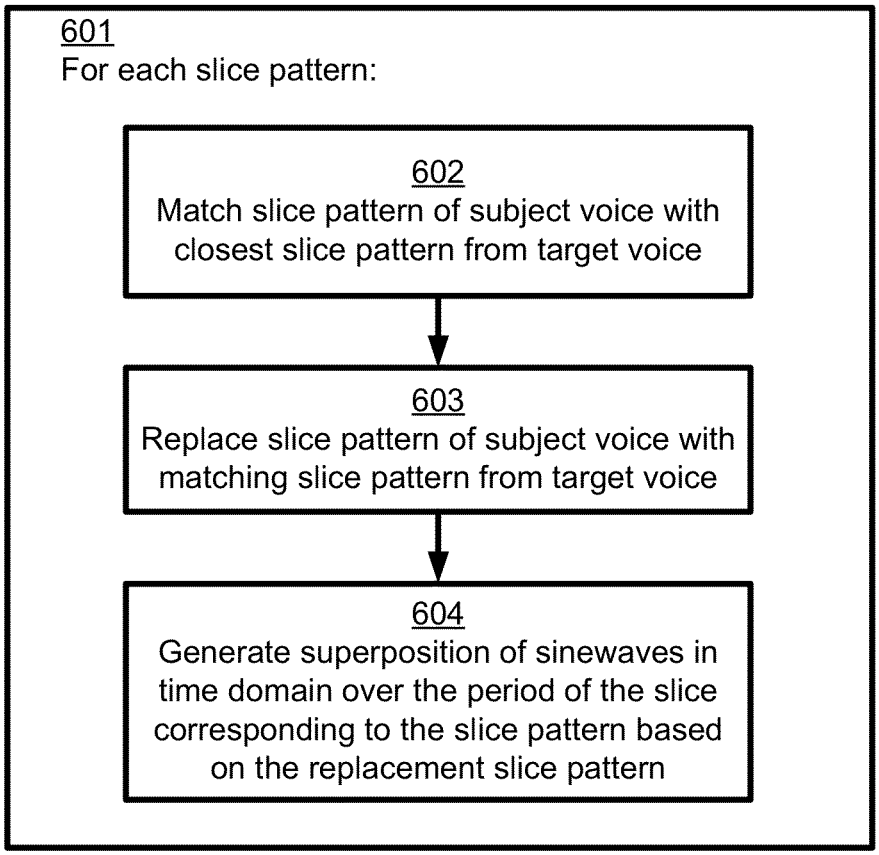
FIG. 6 is a flowchart illustrating a method of altering a subject voice to mimic a target voice, in accordance with an embodiment.

FIG. 6 is a flowchart illustrating a method 403 of altering a subject voice to mimic a target voice, in accordance with an embodiment. The method 403 can be used in the context of the method described above with reference to FIG. 4, or the method 403 may be used as a stand-alone method of altering a voice to mimic a target voice, for example to apply an audio avatar to a subject voice. However, this method assumes that the target voice and the subject voice have already been analyzed and characterized to determine the set of M slice patterns characteristic of the respective voice, for example according to the method illustrated in FIG. 5.

In step 601, each slice pattern of a set of M slice patterns characteristic of the subject voice is analyzed separately either in series or parallel, for example by a voice changing module 207 of a voice analysis and altering module 113. In step 602, the slice pattern of the subject is matched with the closest slice pattern from the voice pattern of the target. As discussed above, one example of an algorithm to perform this matching begins with normalizing the subject's pattern and the target's pattern, for example by setting the first frequency f(1) to 1, and the remaining frequencies expressed as a multiple of the first frequency, f(1). After all of the frequencies have been normalized, the pair of patterns are examined term by term, and the root mean square (RMS) difference between the (a) frequencies and (b) intensities are computed. The distance between the two patterns is then calculated as the root mean square frequency difference multiplied by the root mean square intensity difference. Thus, the closest pattern corresponds to the minimum calculated distance. In step 603, the slice pattern of the subject voice is replaced by the matching slice pattern from the target, for example by the substitution module 209 of the voice changing module 207. Then, in step 604, a superposition of sine waves in the time domain are generated over the time period of the slice corresponding to the slice pattern, based on the replacement slice pattern. The voice changing module 207 iterates steps 602-604 over each slice pattern in the set of M slice patterns in the voice pattern for a subject voice.

Figure 7:
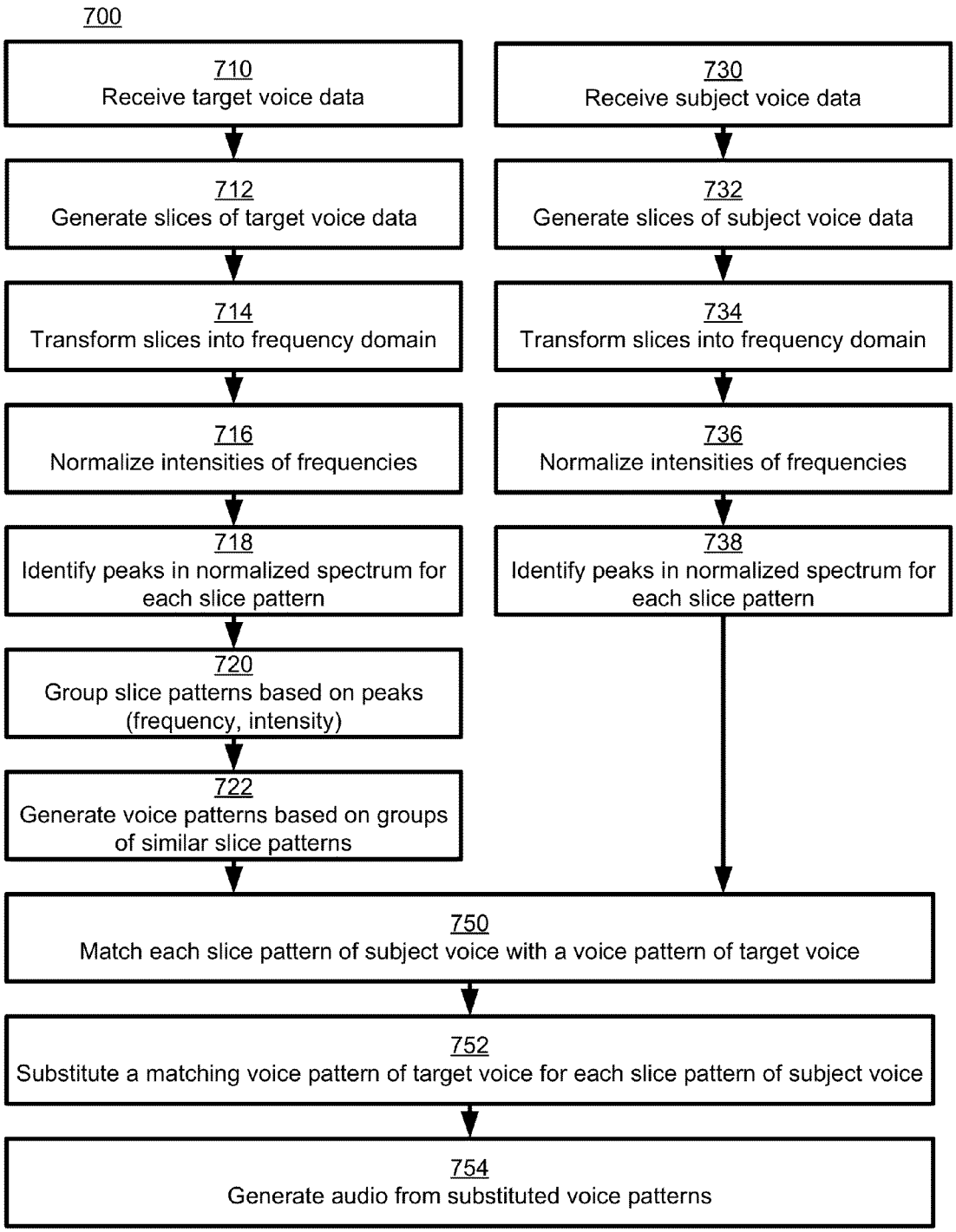
FIG. 7 is a flowchart illustrating a method of generating audio from substituted voice patterns from a target voice, in accordance with an embodiment.

FIG. 7 is a flowchart illustrating a method of generating audio from substituted voice patterns from a target voice, in accordance with another embodiment. This example method illustrates how to transform one sound, referred to as a subject voice into another sound, referred to as a target voice. The target voice (e.g. a person's voice) is used to alter or otherwise replace a subject voice. The spoken words and phrases of the subject voice are preserved, but those words and phrases sound as though spoken by the target voice. In general, a subject voice or even non-voice sound may be replaced with any other voice or non-voice sound. For example, one person's voice may be replaced with another person's voice. In a second example, the "speech" of a robot may be used to replace a person's voice or other acoustic data. In another example, the audio output of a computational device or software application containing artificial intelligence may be replaced with a selected target voice.

In one embodiment, the target voice data is processed and short segments of sound information are recorded in memory where methods may be applied to transform the subject voice data in real-time or near real-time. The target voice data is received as input in step 710. The target voice generally comprises an audio file or audio stream comprising various words or phrases spoken by a person. The words and phrases in the target voice should be comprehensive enough to include all of the atomic sounds normally produced by the subject voice. The target voice is then digitized (if applicable) and parsed to generate 712 multiple sequential time segments referred to as slices, each slice being on the order of 10 to 50 milliseconds in duration. The slices may be acquired at intervals less than the slice duration in order to produce overlapping slices. This overlap between successive slices helps to produce continuity in the frequency profiles of those slices.

Each slice is then transformed 714 into the frequency domain using a Fast Fourier Transform (FFT) algorithm or Infinite Impulse Response (IIR) filter banks, for example. After this processing, each slice is represented as a spectrum including a range of frequencies, each frequency given by a particular intensity (and phase, optionally). For the FFT, a windowing scheme may be performed on the time domain samples before the FFT is calculated in order to reduce aliasing and other unwanted artifacts. The frequency extraction from the FFT result is limited to a range somewhat larger than the known range of the human voice, typically 50-5000 Hz. In other embodiments, a low-pass filter or band-pass filter may be applied to limit the bandwidth to useful frequencies in a range of interest.

Each spectrum is normalized 716 using the integrated intensity of the spectrum after filtering. A predetermined number, N, of dominant peaks in each spectrum are identified 718 from the normalized spectrum. The dominant peaks correspond to the frequencies exhibiting the greatest intensity. Only the dominant peaks of a slice are retained and used to form a slice pattern which is recorded as a vector of data pairs, each data pair comprising a representation of the frequency and intensity of a dominant peak (or data triplets if phase is used). The frequency of the first pair—referred to herein as the base frequency—is recorded in Hertz. The remaining frequencies of the vector are represented as a ratio, each ratio being the frequency of that peak divided by the base frequency. In the preferred embodiment, a predetermined number of peaks (e.g., sixteen to forty) are recorded for each slice pattern. The remaining peaks, being the dominant frequencies, produce the signature sound of the target voice data. These peaks may also be used to identify the age and/or gender of the voice.

Clustering is then employed to obtain a representative subset of frequencies with which to model sounds in the target voice data. The slice patterns of the target voice are compared to one another to identify similar patterns, i.e., slices with similar frequency composition and structure. In particular, a plurality of similar slice patterns are identified and grouped 720 based on the similarity of the dominant frequencies as well as the intensities of those dominant frequencies, using k-means clustering or x-means clustering or any other clustering or classification algorithm, for example. K-means clustering effectively collects the slice patterns into groups, where each group is defined by a cluster region or boundary in a multi-dimensional frequency/intensity space. In general, each group includes a plurality of slice patterns that are clustered near one another in that multi-dimensional space. For each group, the centroid of the plurality of slice patterns is used to generate 722 an individual slice pattern representative of the plurality of slice patterns grouped in the cluster. The set of representative slice patterns are referred to herein as voice patterns. In other embodiments, a group of slice patterns are "combined" by averaging the slice patterns of a group, or by identifying center peaks of clusters of dominant peaks present in the slice patterns. Reduction of multiple slice patterns into a single voice pattern has many benefits, namely (1) it reduces the number of slice patterns necessary to transform the subject voice data into the target voice, (2) it reduces the processing time necessary to transform the subject voice to the target voice, and (3) it reduces noise in the slice patterns.

Like the target voice data, the subject voice data may be an audio file or an audio stream containing voice and/or non-voice sounds. The subject voice data is received as input in step 730. The subject voice data is parsed to generate 732 a plurality of slices and each slice is transformed 734 into the frequency domain and filtered. The spectrum of each slice is normalized 736 using the integrated intensity of the spectrum after filtering. The dominant peaks of the spectra are identified 738 and used to generate slice patterns, as described above.

Each slice pattern of the subject voice is then matched 750 to the most similar target slice pattern, namely the most similar voice pattern. In one embodiment, a match is identified using a distance metric in a multi-dimensional hyperspace representing the frequencies and intensities of dominant peaks, as well as phases prosody in some embodiments. Each voice pattern corresponds to a single point in the multi-dimensional hyperspace in which each axis corresponds to one possible frequency (represented by based frequency and frequency ratios) in the slice spectra. The distance metric is then used to identify the voice pattern "closest" to the subject slice pattern. The closest point may be the "nearest neighbor" determined based on the Euclidian distance or using a Manhattan distance algorithm, for example. Once the nearest neighbor is identified, the voice pattern is selected to substitute 752 for the corresponding subject slice pattern. The matching process and substitution process are repeated for each subject slice pattern of the subject voice data. An audio file is generated 754 from the sequence of voice patterns, which are transformed from the frequency domain back to the temporal domain, the slices concatenated in the sequence in which they were originally parsed, and the corresponding audio file outputted to an audio player. The effect is that the "voice" in the subject voice data will sound like that of the target voice, but the message and meaning in the original subject voice will be preserved.

User Interface Examples

FIGS. 8-17 are a set of example user interface drawings for a smartphone implementation of an anonymous social networking application that allows users to contribute a voice-based post that is altered to sound like an audio avatar, in accordance with an embodiment. A similar set of user interfaces may be used for tablet, laptop, or desktop implementations of the application 121. A smartwatch implementation of the application 121 will be described below with reference to FIGS. 18-23.

Figure 8:
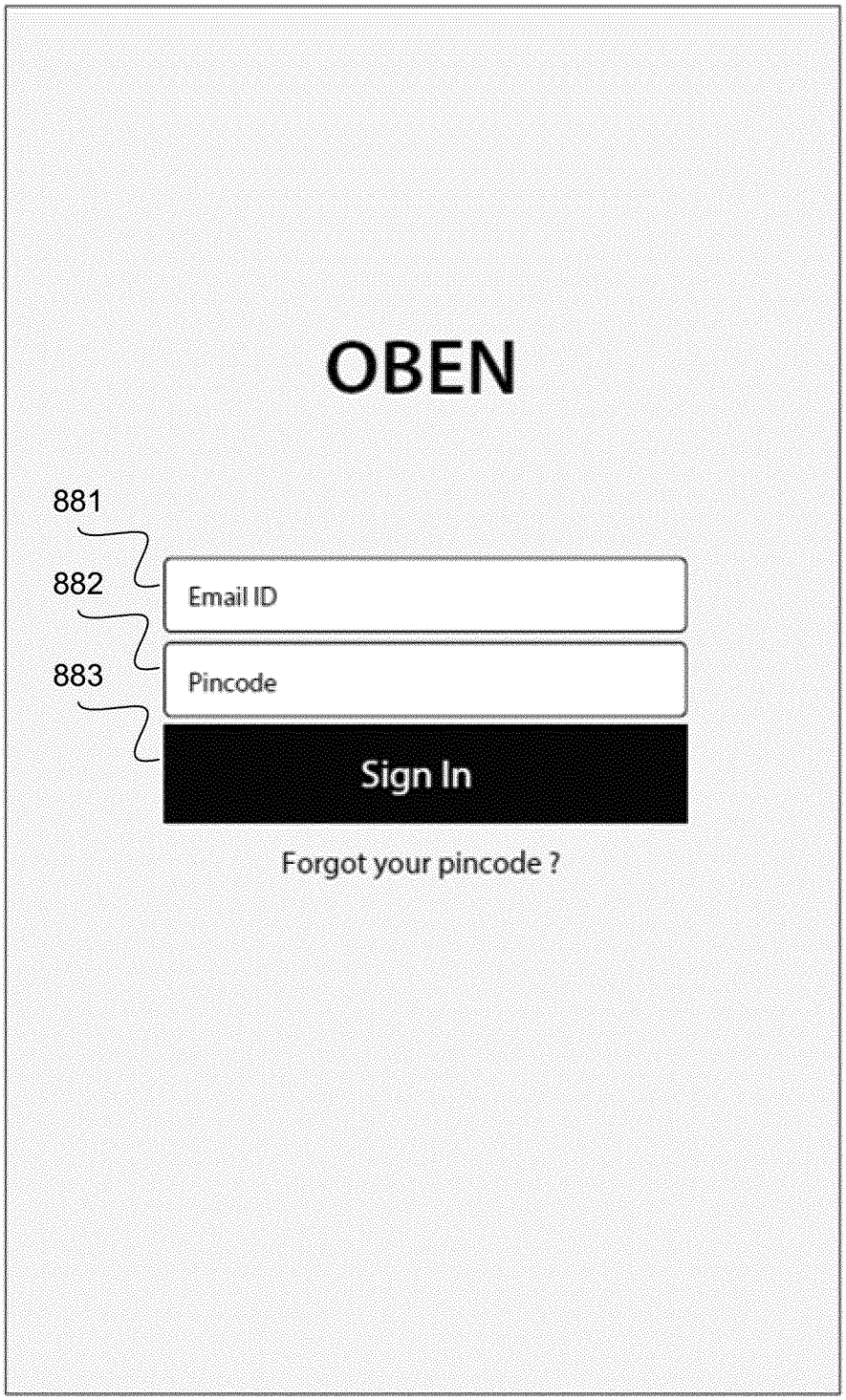
FIG. 8 is an example user interface illustrating a log-in screen for an anonymous social networking application, in accordance with an embodiment.

FIG. 8 is an example user interface illustrating a log-in screen for an anonymous social networking application 121, in accordance with an embodiment. A user enters the user's email ID into box 881, the user's pincode into box 882, and selects the sign in button 883 when complete. This triggers the server interaction module 122 of the application 121 to attempt to authenticate the user to the server system 110.

Figure 9A:
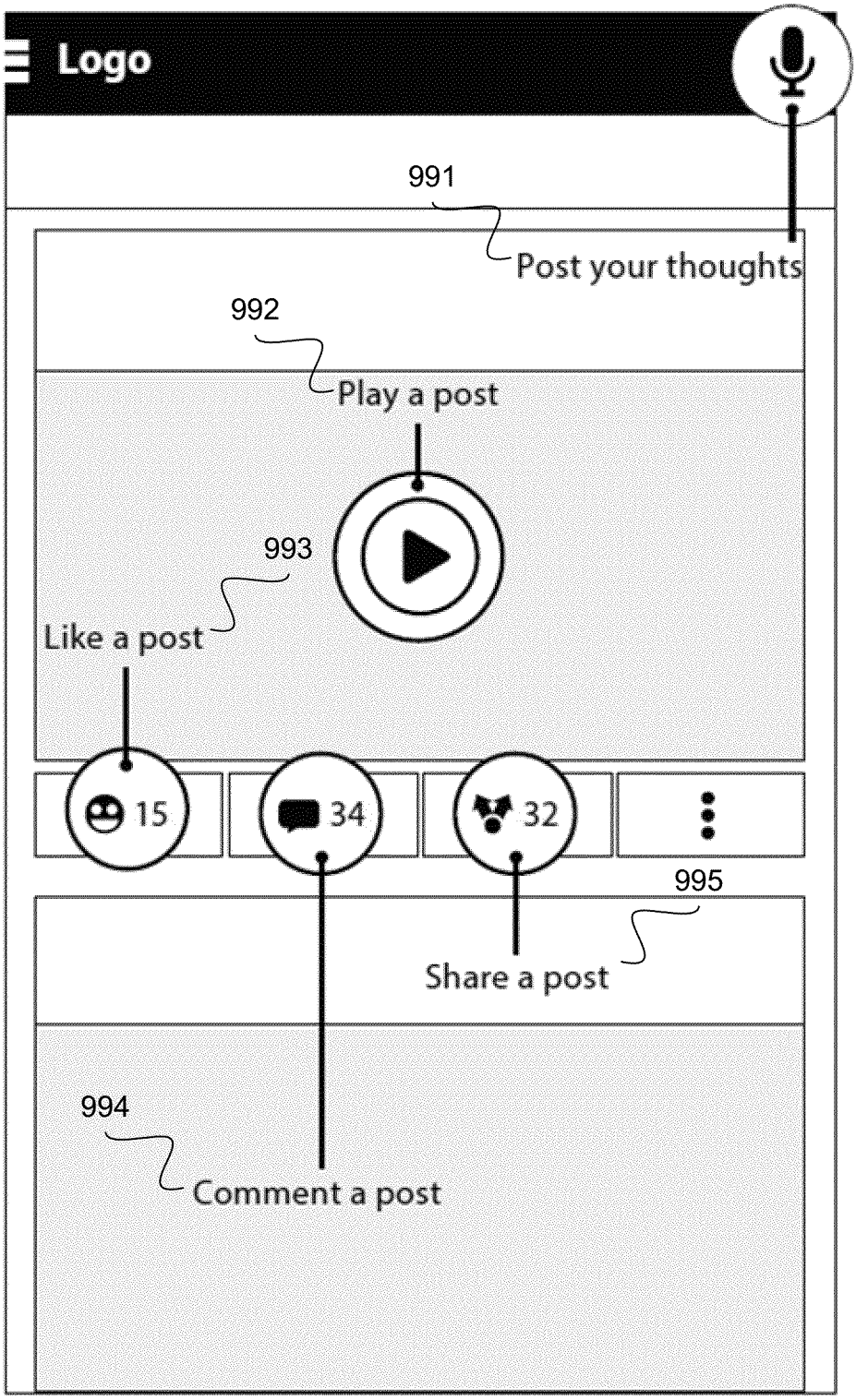
FIGS. 9A, 9B, and 10 are example user interfaces illustrating a tutorial to orient a user to the anonymous social networking platform, in accordance with an embodiment.
Figure 9B:
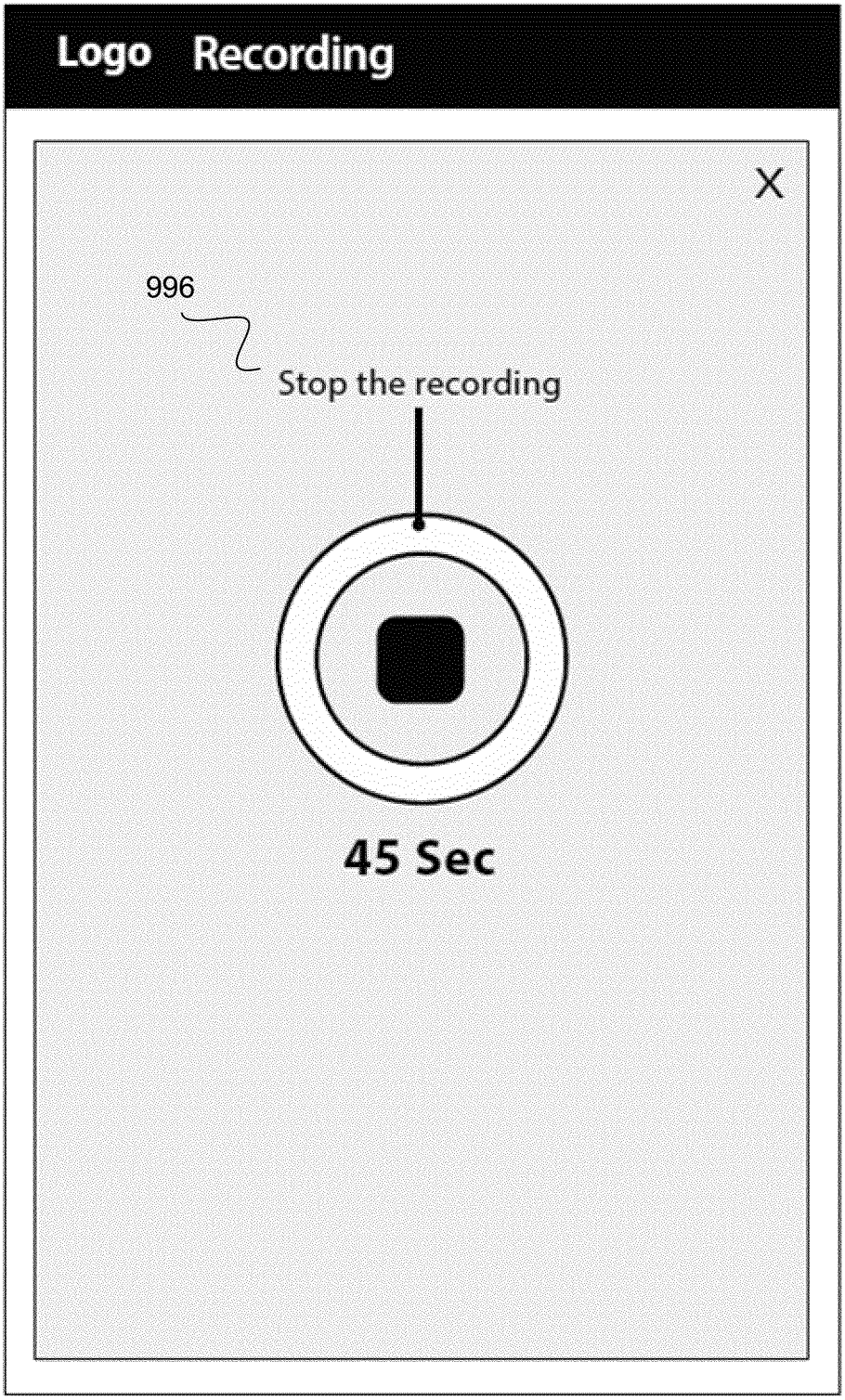
Figure 10:
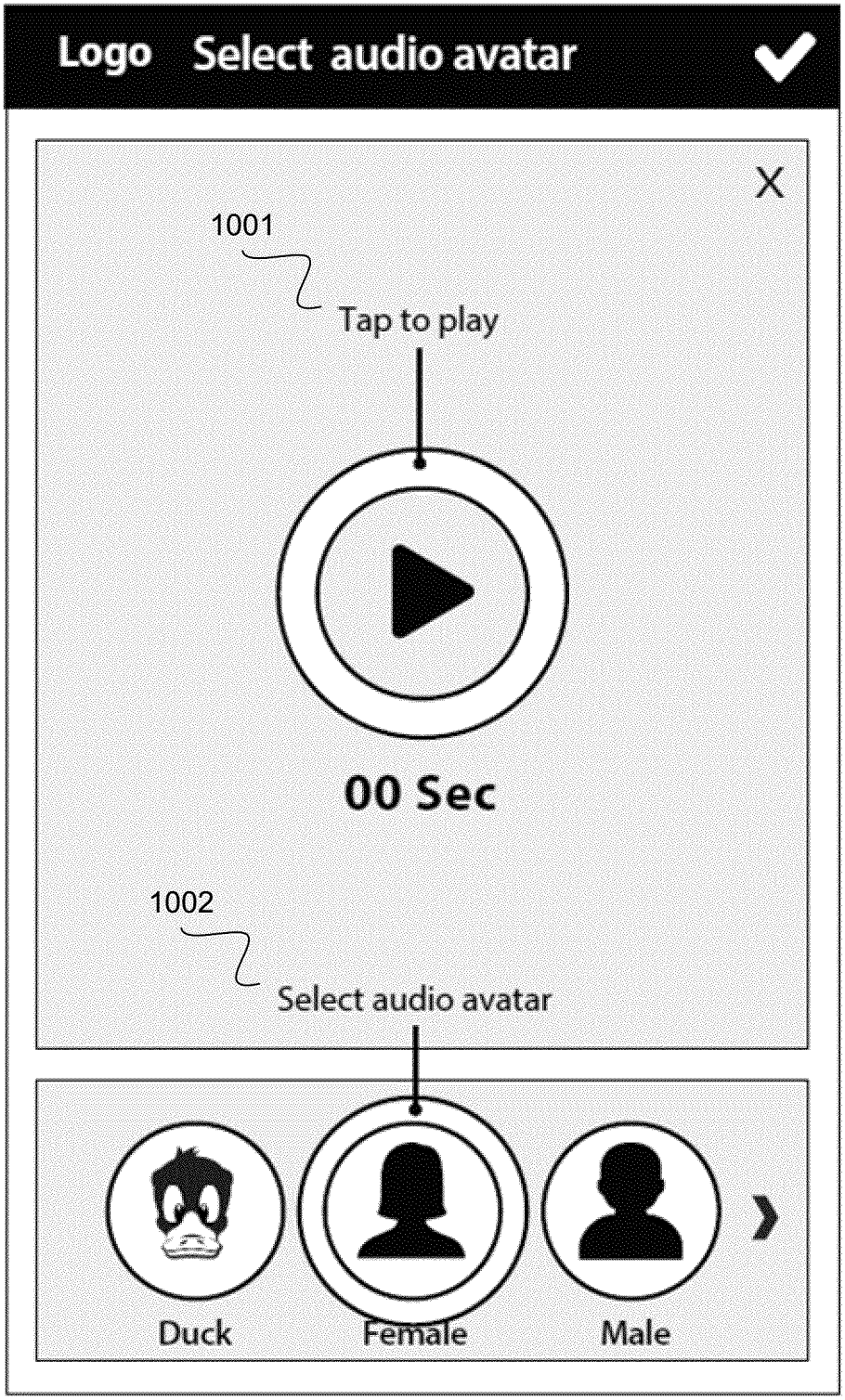

FIGS. 9A, 9B, and 10 are example user interfaces illustrating a tutorial to orient a user to the anonymous social networking platform, in accordance with an embodiment. The user is educated by reading the hints displayed on screen as to which icons should be selected to post your thoughts 991, play a post 992, like a post 993, comment a post 994, share a post 995, stop the recording 996, tap to play 1001, and select audio avatar 1002.

Figure 11:
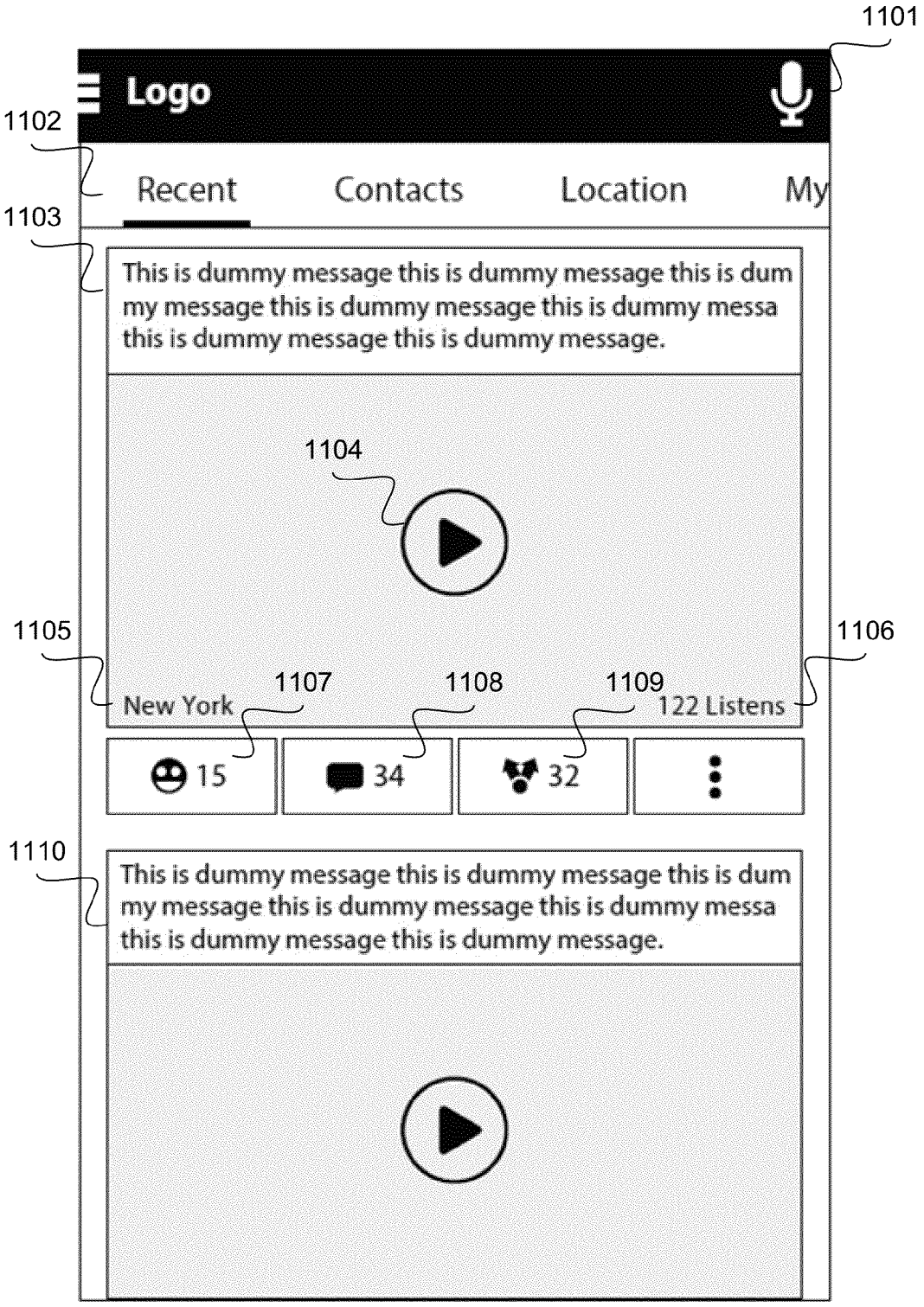
FIG. 11 is an example user interface illustrating recent posts to the anonymous social networking platform, in accordance with an embodiment.
Figure 12:
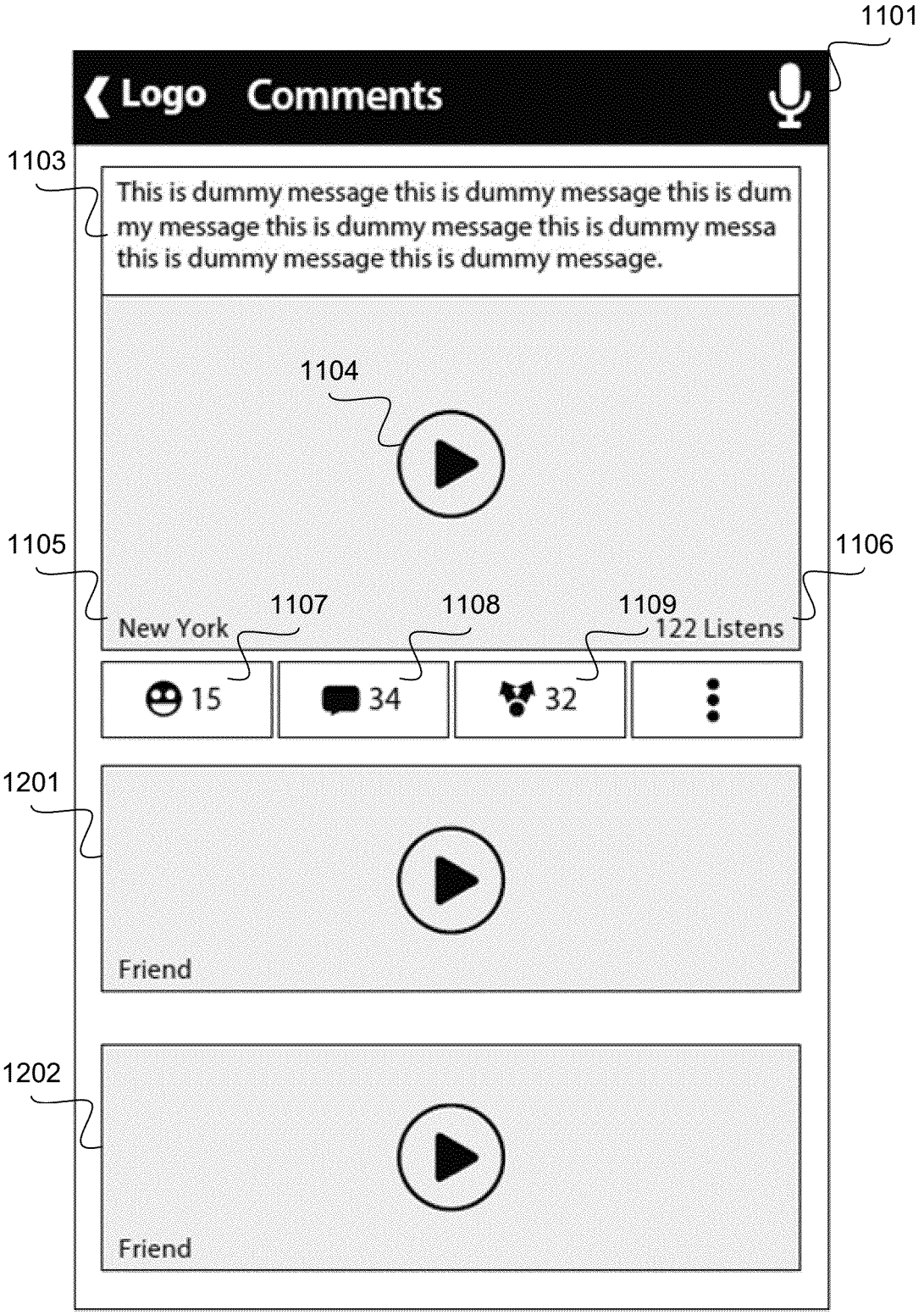
FIG. 12 is an example user interface illustrating comments made on a recent post to the anonymous social networking platform, in accordance with an embodiment.
Figure 13:
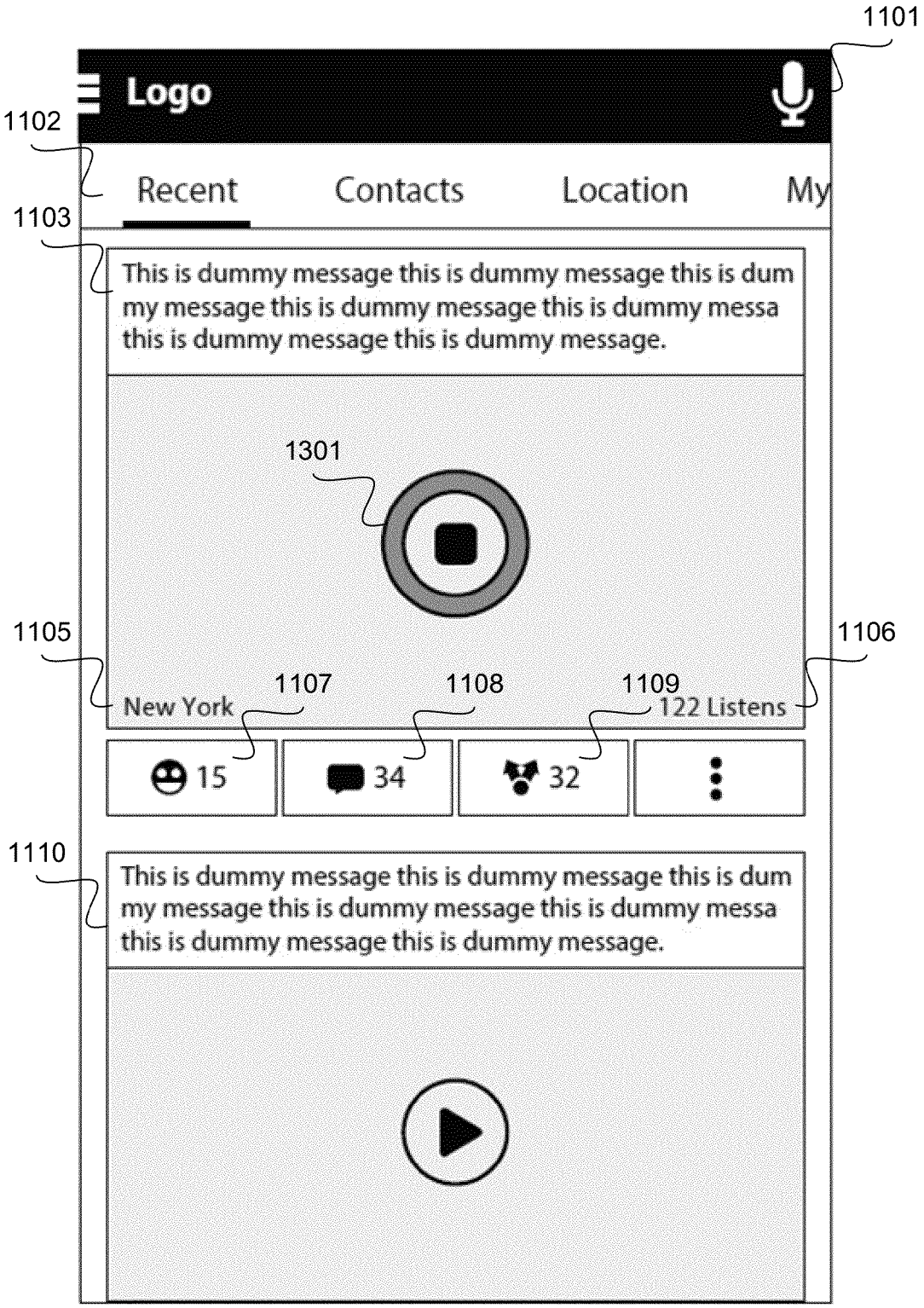
FIG. 13 is an example user interface illustrating playback of a recent post to the anonymous social networking platform, in accordance with an embodiment.

FIGS. 11-13 are example user interfaces illustrating the view and playback posts the anonymous social network. FIG. 11 illustrates recent posts 1103 and 1110 to the anonymous social networking. The user interface also includes a microphone icon 1101 and a horizontal menu to select a sorting/filtering paradigm 1102. The user selects the microphone icon 1101 when the user wants to record a post. The user selects from the menu 1102 to view posts in order by according to how recent they were posted, to view posts only from a group of social network contacts, the view posts by location, etc. Each post 1103, 1110 includes a button for playback 1104, an indication of the location from which the post was made 1105, a total number of listens 1106 which serves as a measure of exposure of the post, as well as the number of people who liked the post 1107, the number of comments made on the post 1108, and the number of times the post of shared 1109. FIG. 12 illustrates comments 1201 and 1202 made on a recent post 1103 to the anonymous social networking platform. The comments 1201 and 1202 can be displayed in a list below the primary post 1103 to which they relate. FIG. 13 illustrates playback of the recent post 1103. The play button 1104 illustrated in FIG. 12 changes to the stop playback icon 1301 during playback.

Figure 14:
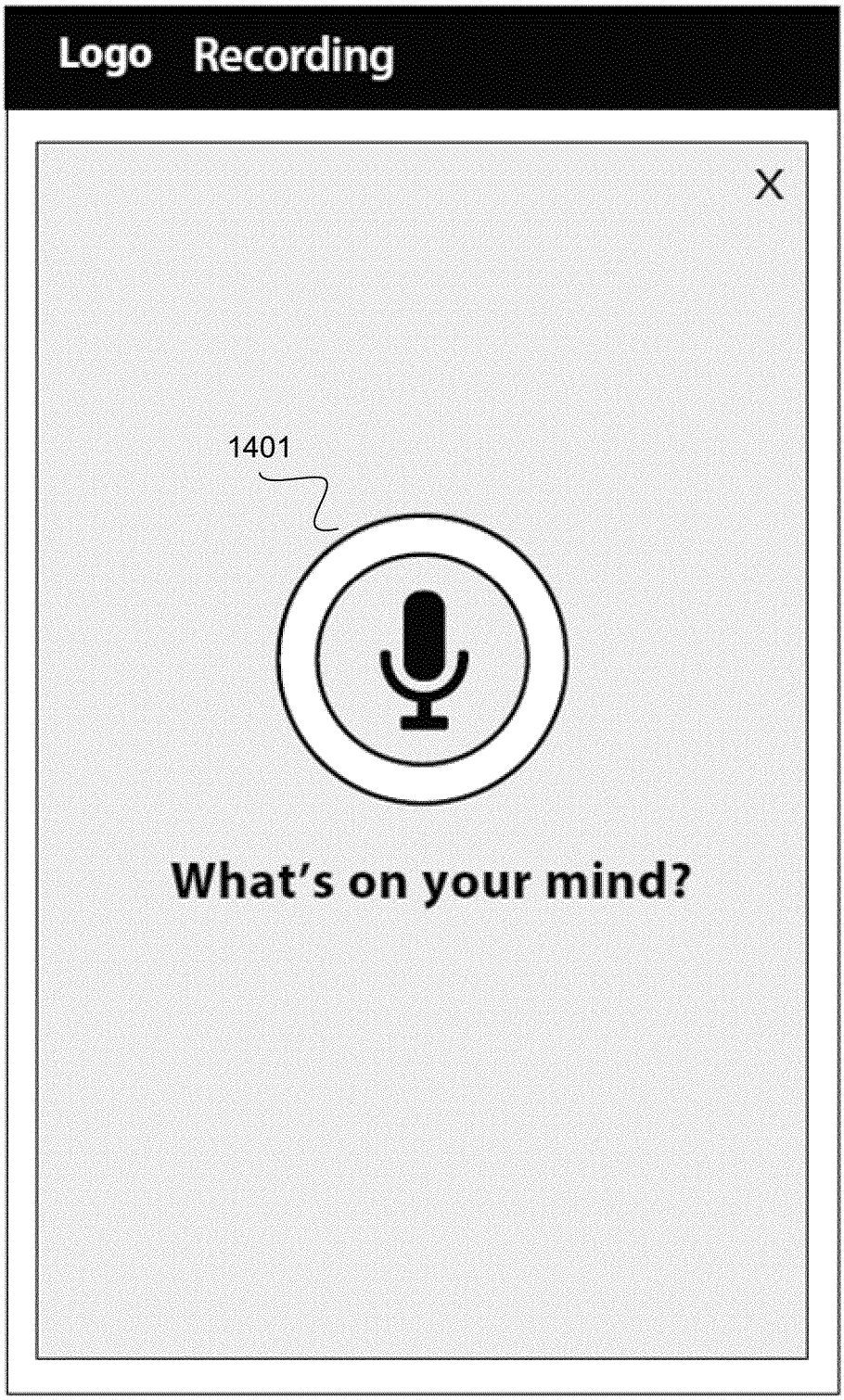
FIG. 14 is an example user interface illustrating recording a post to the anonymous social networking platform, in accordance with an embodiment.
Figure 15:
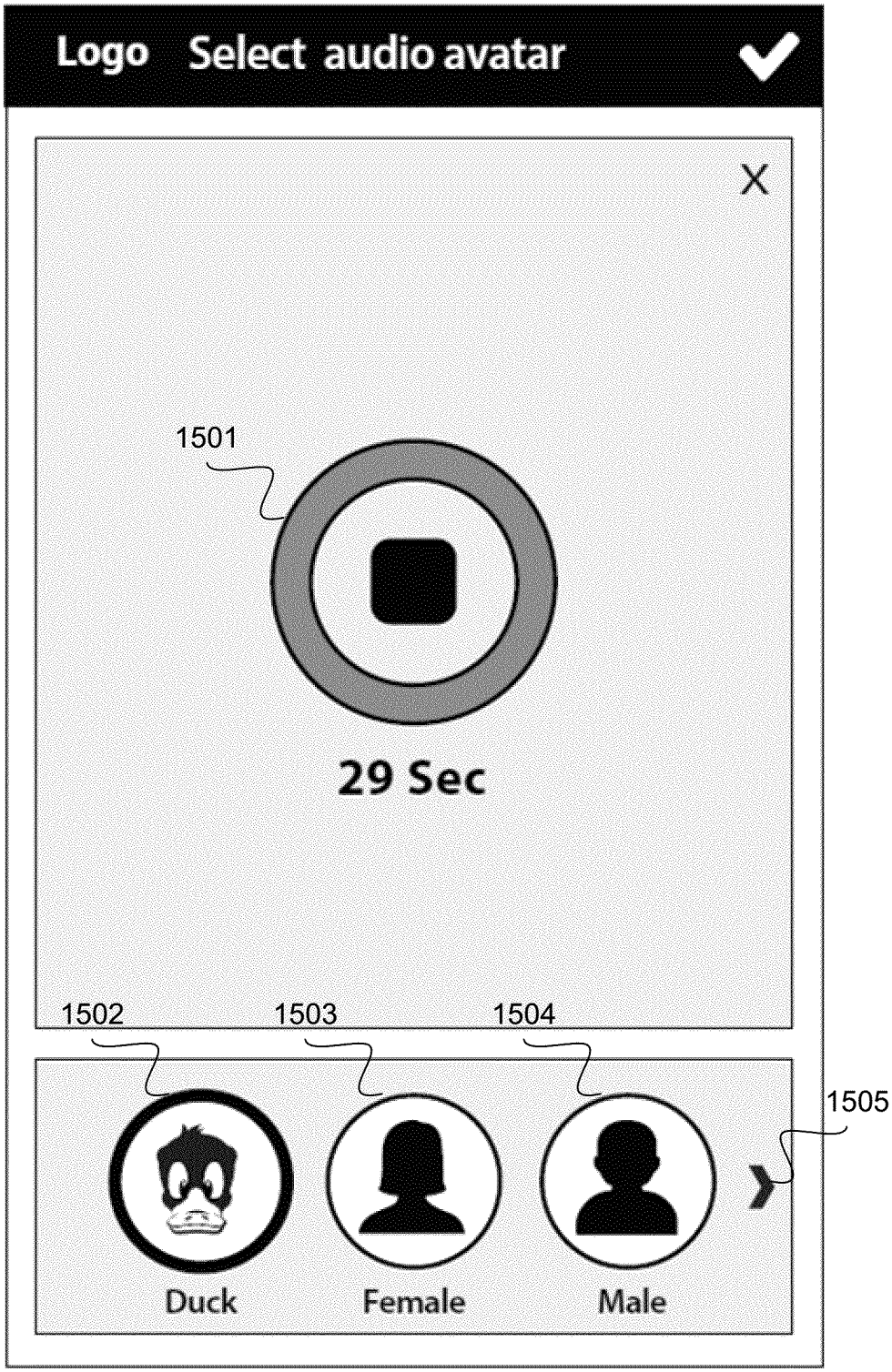
FIG. 15 is an example user interface illustrating selecting an audio avatar for a recorded post, in accordance with an embodiment.
Figure 16:
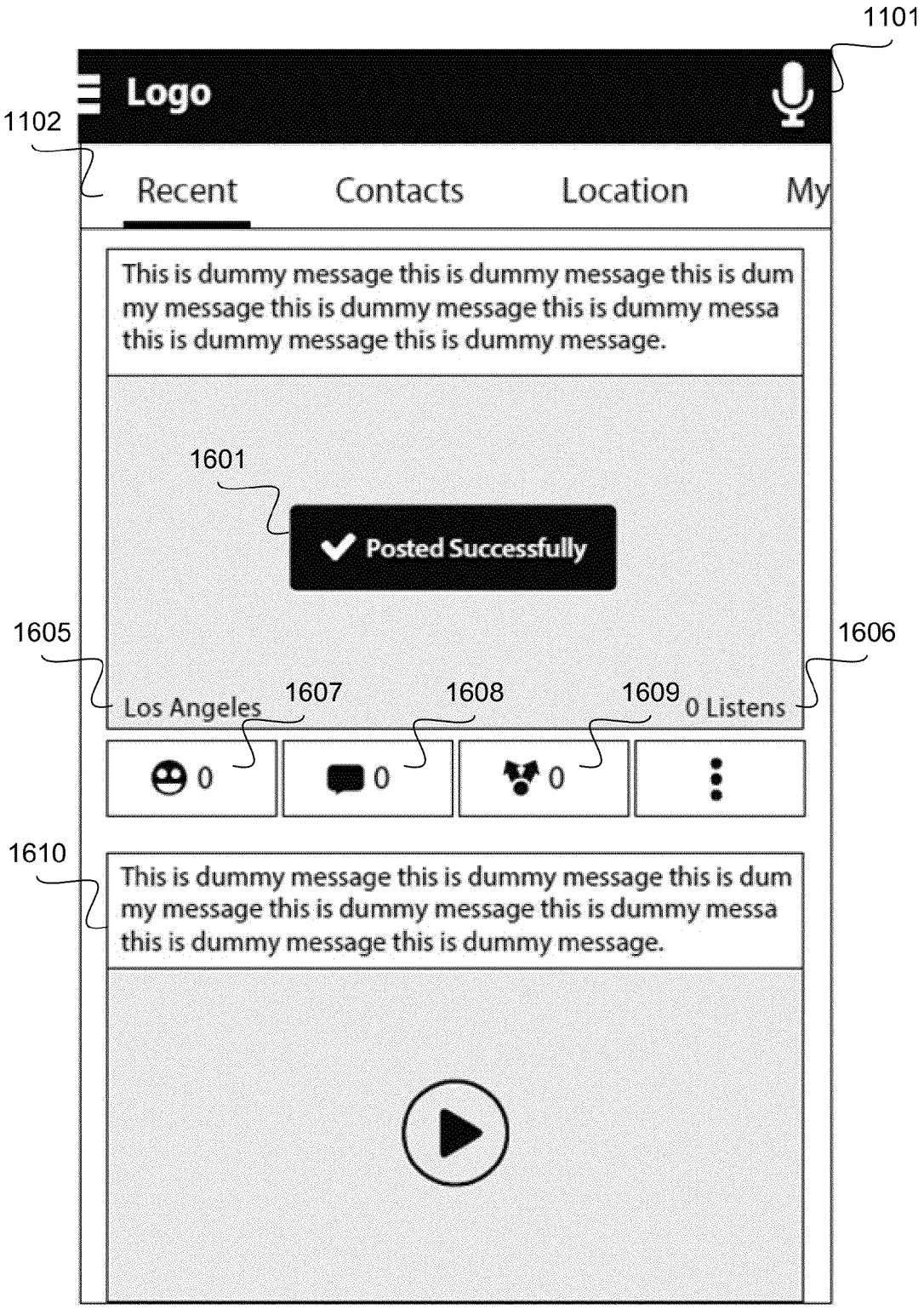
FIG. 16 is an example user interface illustrating the successful post to the anonymous social networking platform, in accordance with an embodiment.

FIGS. 14-16 are example user interfaces illustrating the user's process for posting a new recording to the anonymous social networking platform. FIG. 14 illustrates recording a post. The user selects the microphone icon 1401 to begin recording, and selects a stop icon (shown in FIG. 15 as 1501) to stop recording. FIG. 15 illustrates the selection of an audio avatar for the recorded post. In this example, the user can select from an animated duck voice by selecting the duck icon 1502, a female voice by selecting the female icon 1503, a male voice by selecting the male icon 1504, or may view additional options by selecting the scroll icon 1505. Once the user has submitted the selection of the audio avatar, the user is notified via the interface illustrated in FIG. 16 that the user's contribution to the social network has posted successfully 1601. The location 1605 is updated to reflect the location of the user, the number of listens 1606 is set to zero, and the number of likes 1607, comments 1608, and shares 1609 are set to zero to begin tracking responsive to other users' interactions with the post.

Figure 17:
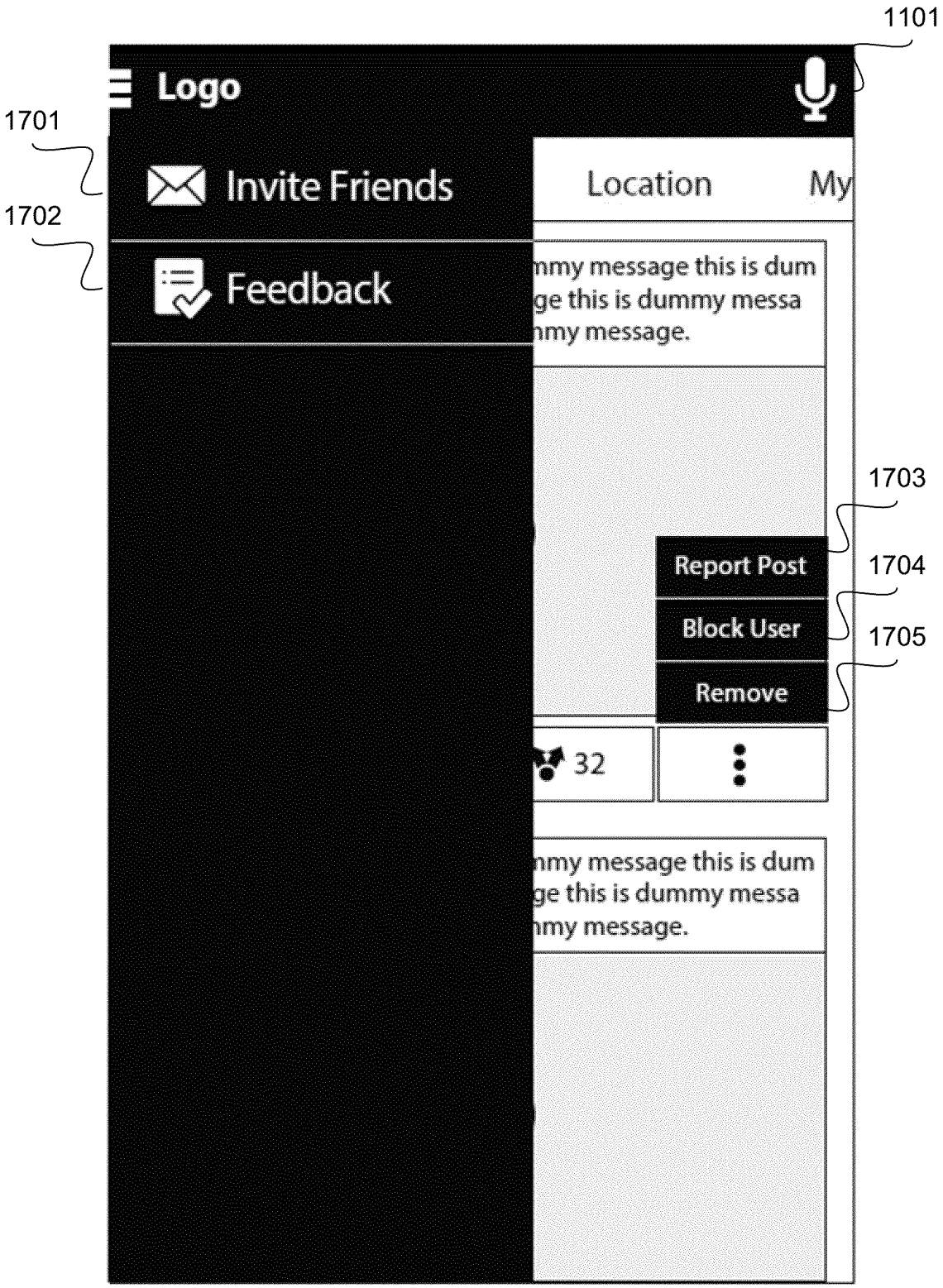
FIG. 17 is an example user interface illustrating additional menu options that support other social network features, in accordance with an embodiment.

FIG. 17 is an example user interface illustrating additional menu options that support other social network features, in accordance with an embodiment. A user can select element 1701 to invite friends to join the social network. The selection of this icon 1701 triggers the launch of an invitation template to capture the contact information for the friend that the user wants to invite and optionally includes space for a personal message from the user to the friend with the invitation. A user can select element 1702 to provide feedback to the administrators of the social network, such as to suggest improvements, report a problem, or the like. The selection of this icon 1702 triggers the launch of a feedback template to capture the user's feedback to the administrators. The user can select the report post menu option 1703 to report a post as being against the community policies of the social network or otherwise problematic. The user can select the block user menu option 1704 to block the posts of a particular contributor to the social network that for any reason the user no longer wishes to encounter. The blocking of a user can be stored, for example, in the user preferences stored by the user account module 112 or in the data store 114 so that the policy can be applied to future posts in addition to existing posts from that user. The user can select the remove menu option 1705 to remove a post from the social network. If the user removes the user's own post to the social network, it can no longer be played back by from the server system 110 by anyone in the social network. In one embodiment, if a first user removes a post of a second user, the post is merely hidden from the first user's view and will not be subsequently played back for the first user, but the second user and the rest of the users of the social network can still play it back.

Figure 18:
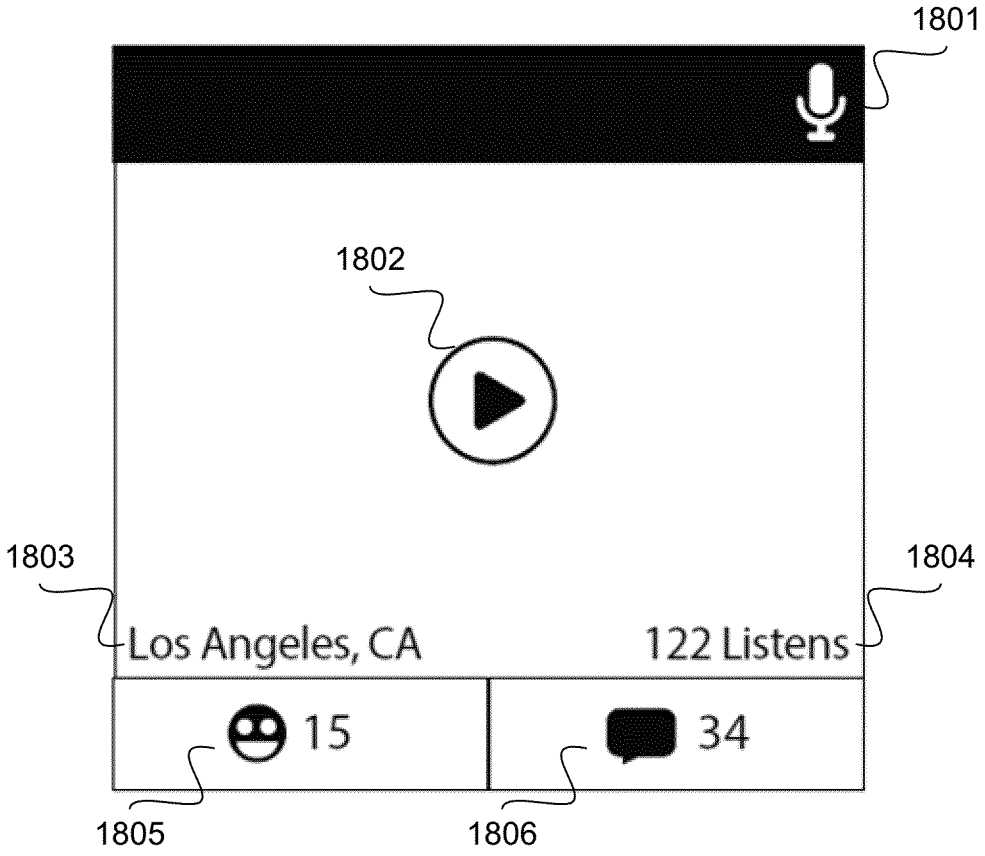
FIG. 18 is an example user interface illustrating social networking platform functions available from a smartwatch, in accordance with an embodiment.
Figure 19:
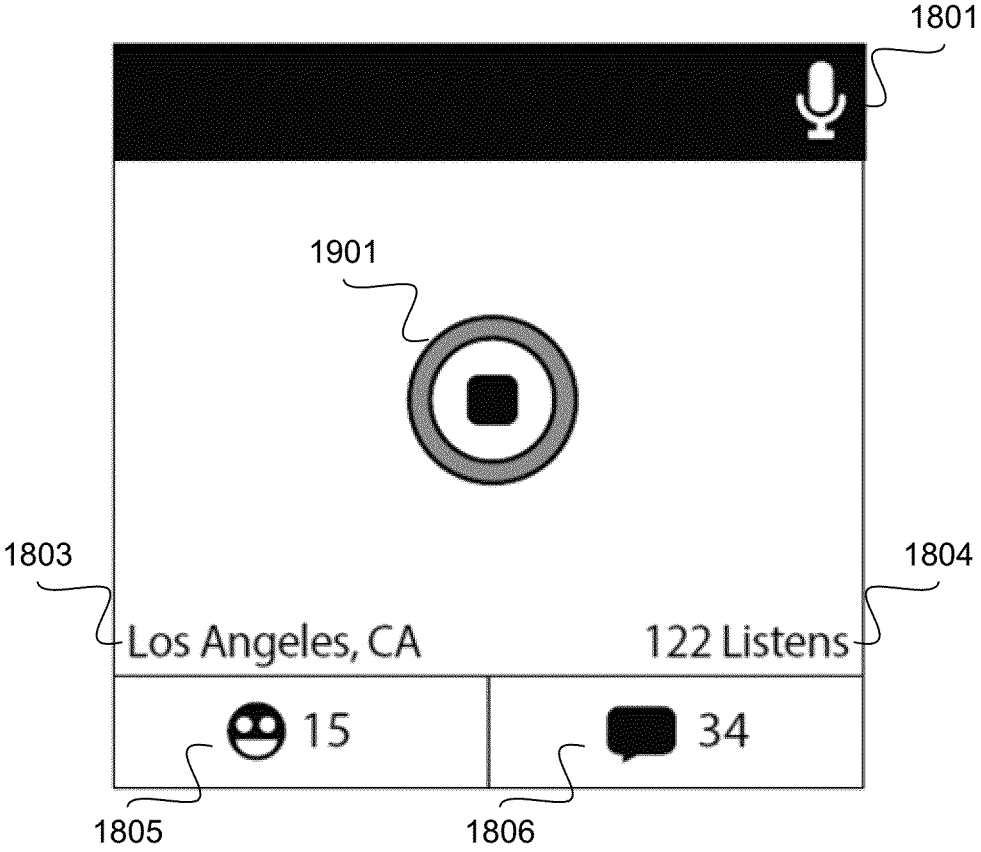
FIG. 19 is an example user interface illustrating playback of a post to the anonymous social networking platform from a smartwatch, in accordance with an embodiment.
Figure 20:
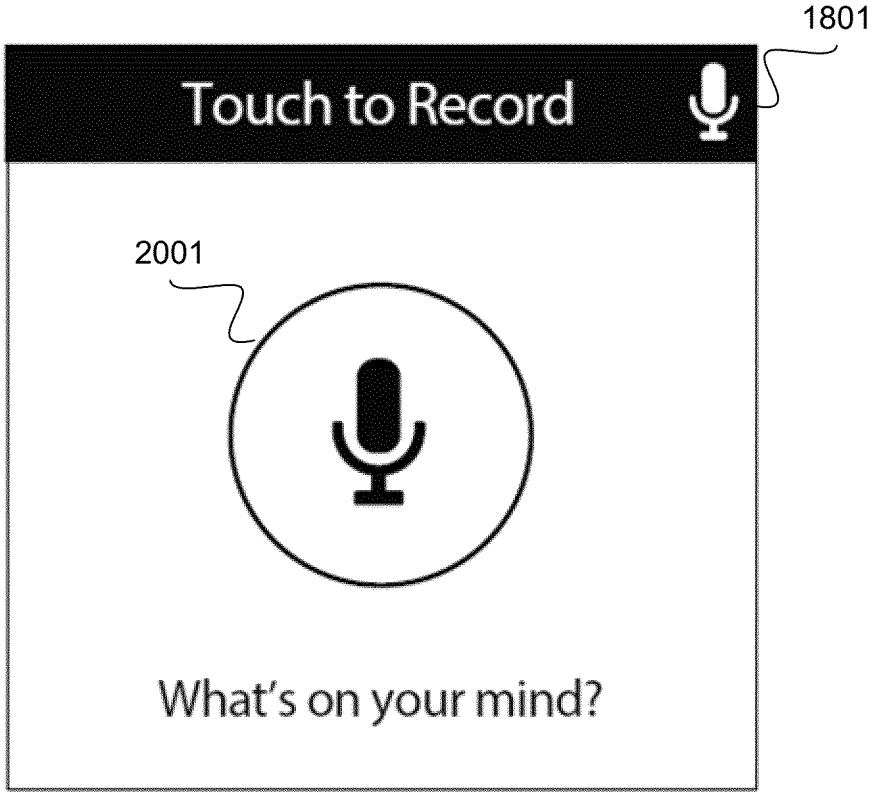
FIG. 20 is an example user interface illustrating how to start recording a post to the anonymous social networking platform from a smartwatch, in accordance with an embodiment.
Figure 21:
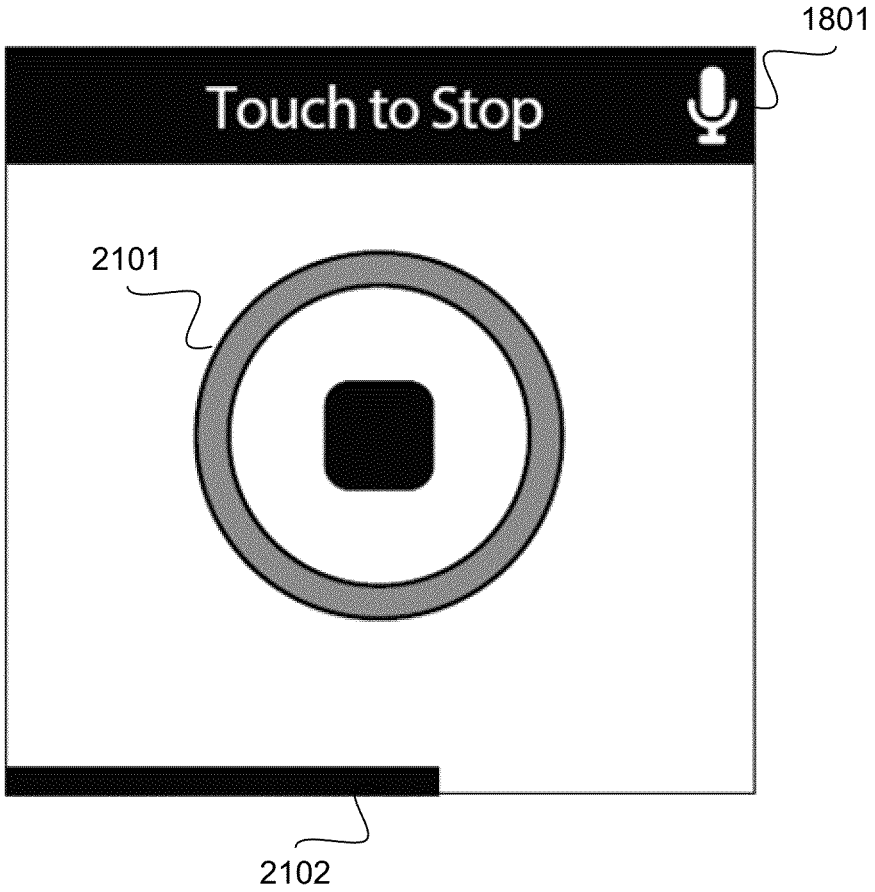
FIG. 21 is an example user interface illustrating recording a post to the anonymous social networking platform from a smartwatch, in accordance with an embodiment.
Figure 22:
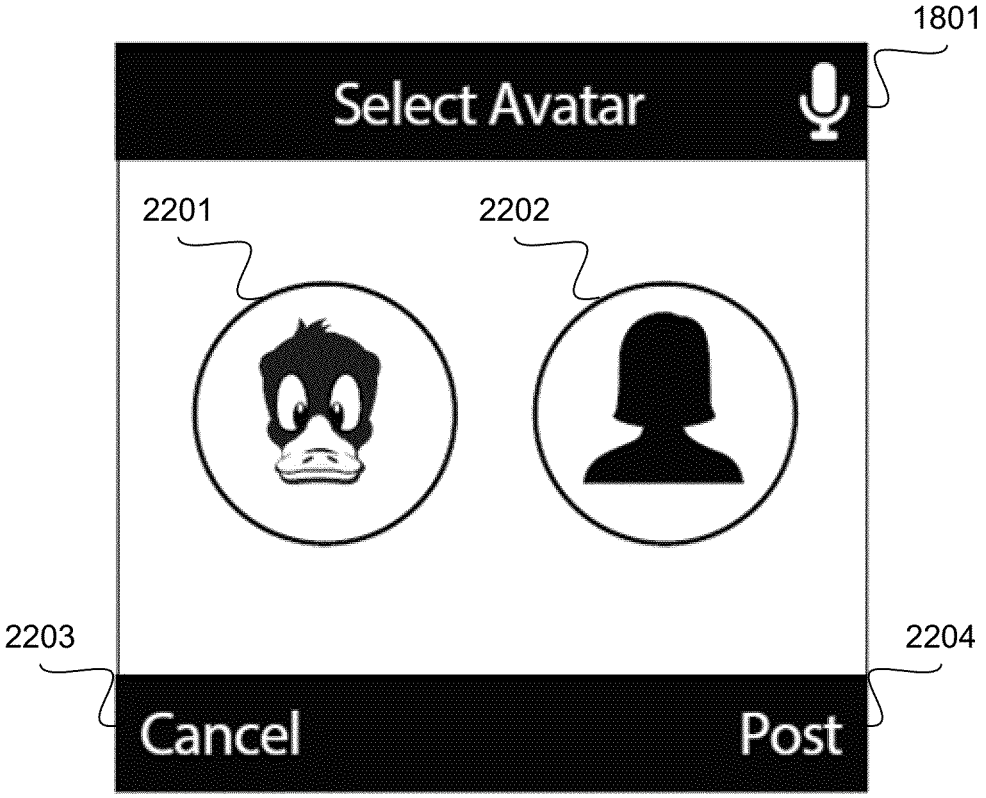
FIG. 22 is an example user interface illustrating selecting an audio avatar for a recorded post from a smartwatch, in accordance with an embodiment.
Figure 23:
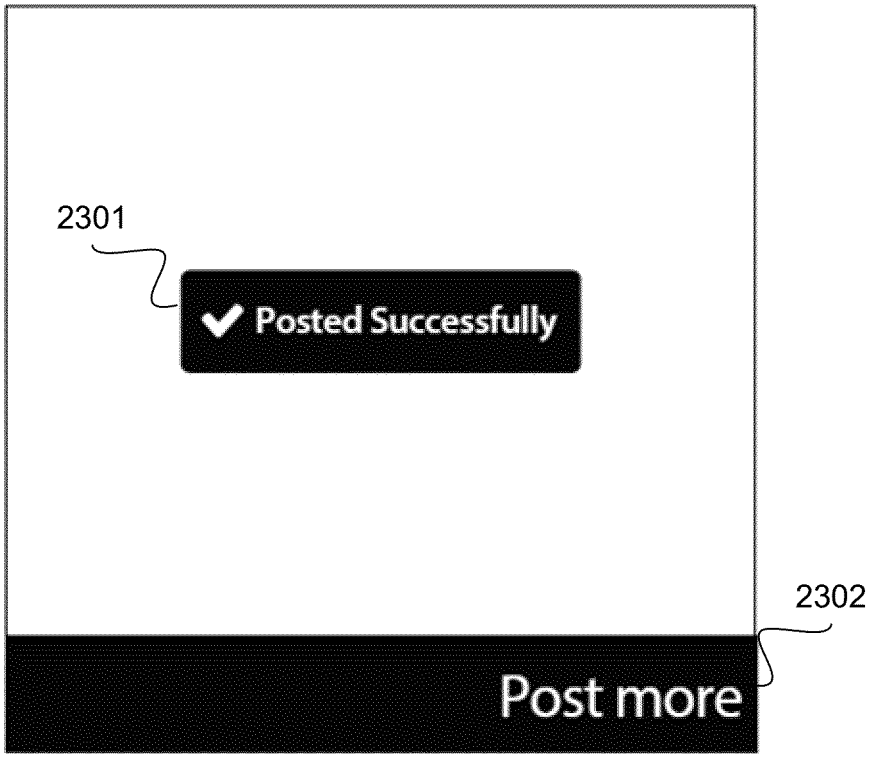
FIG. 23 is an example user interface illustrating the successful post to the anonymous social networking platform from a smartwatch, in accordance with an embodiment.

FIGS. 18-23 are a set of example user interface drawings for a smartwatch implementation, in accordance with an embodiment. FIG. 18 is an example user interface illustrating social networking platform functions available from a smartwatch. The user can select the microphone icon 1801 to make a new recording. The user can playback a currently selected post by selecting the play icon 1802. This example currently selected recording is from the location 1803 of Los Angeles, Calif., and the current count of the number of listens 1804 is 122. By selecting button 1805, the user can like the currently selected post. By selecting button 1806, the user can comment on the currently selected post. The label of both buttons 1805 and 1806 contain updated numbers regarding the counts for each of those activities in relation to the currently selected post. FIG. 19 illustrates the playback of a post. The user selects button 1901 to stop the playback. FIG. 20 illustrates how to start recording a post. The user selects button 2001 to begin recording. FIG. 21 illustrates the user interface during a recording. A progress bar 2102 grows across the bottom of the user interface as visual feedback to the user so that they user sees the length of the recording so far. The user selects button 2101 when the user is finished recording. FIG. 22 illustrates selecting an audio avatar for a recorded post. In this example, the user can select the duck to choose an animated duck voice 2201 or the woman to choose a female voice 2202 as the audio avatar to be applied to the recording. In some implementations, dozens or hundreds or even more audio avatars may also be available. The user can cancel the posting by selecting the cancel button 2203. However, if the user is satisfied with the post and the selection of an audio avatar for the post, the user can post the recording by selecting the post button 2204. FIG. 23 illustrates the message 2301 given to the user after a successful post is made. If the user selects the post more button 2302, the user returns to the interface illustrated in FIG. 20 for making a new recording.

Additional Configuration Considerations

Some portions of the above description describe the embodiments in terms of algorithmic processes or operations. These algorithmic descriptions and representations are commonly used by those skilled in the data processing arts to convey the substance of their work effectively to others skilled in the art. These operations, while described functionally, computationally, or logically, are understood to be implemented by computer programs comprising instructions for execution by a processor or equivalent electrical circuits, microcode, or the like. Furthermore, it has also proven convenient at times, to refer to these arrangements of functional operations as modules, without loss of generality. The described operations and their associated modules may be embodied in software, firmware, hardware, or any combinations thereof.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the disclosure. This description should be read to include one or at least one and the singular also includes the plural unless it is obvious that it is meant otherwise.

Upon reading this disclosure, those of skill in the art will appreciate still additional alternative structural and functional designs. Thus, while particular embodiments and applications have been illustrated and described, it is to be understood that the described subject matter is not limited to the precise construction and components disclosed herein and that various modifications, changes and variations which will be apparent to those skilled in the art may be made in the arrangement, operation and details of the method and apparatus disclosed herein.

What is claimed is:

1. A method of transforming a subject voice to a target voice, the method comprising:

receiving subject voice data and target voice data;

generating a first plurality of slice patterns from the target voice data;

generating a second plurality of slice patterns from the subject voice data;

identifying a plurality of slice groups, each slice group comprising a plurality of the first plurality of slice patterns from the target voice data;

generating a plurality of voice patterns, each voice pattern being generated from one of the plurality of slice groups;

substituting one or more of the second plurality of slice patterns from the subject voice data with one of the plurality of voice patterns;

generating an audio signal from the voice patterns; and outputting the audio signal.

2. The method of claim 1, wherein generating the first plurality of slice patterns from the target voice data comprises:

parsing the target voice data into a plurality of slices; and for each of the plurality of slices parsed from the target voice data:

extracting frequency content of the slice;

identifying a plurality of dominant frequency peaks, each peak associated with a respective frequency, intensity, and phase; and generating a slice pattern based on the plurality of dominant frequency peaks.

3. The method of claim 2, wherein identifying the plurality of slice groups comprises:

identifying clusters of the first plurality of slice patterns from the target voice data using k-means clustering or x-means clustering; wherein the clusters are based on the frequency and intensity of the dominant frequency peaks of the plurality of slices parsed from the target voice data.

4. The method of claim 3, wherein generating the plurality of voice patterns comprises:

generating a single voice pattern for each of the identified clusters, wherein each voice pattern is based on a centroid of a respective cluster.

5. The method of claim 1, wherein generating the second plurality of slice patterns from the subject voice data comprises:

parsing the subject voice data into a plurality of slices; and for each of the plurality of slices parsed from the subject voice data:

extracting frequency content of the slice;

identifying a plurality of dominant frequency peaks, each peak associated with a respective frequency, intensity, and phase; and generating a slice pattern based on the plurality of dominant frequency peaks.

6. The method of claim 1, wherein substituting one or more of the second plurality of slice patterns from the subject voice data with one of the plurality of voice patterns comprises:

identifying a voice pattern of the plurality of voice patterns that is a nearest neighbor to each respective slice pattern of the second plurality of slice patterns from the subject voice data; and substituting the identified voice patterns for each respective slice pattern of the second plurality of slice patterns from the subject voice data.

7. The method of claim 1, wherein generating an audio signal from the voice patterns comprises:

generating a plurality of slices by transforming each of the voice patterns substituted for a slice pattern form the subject voice data into a temporal domain; and concatenating the plurality of slices generated by the transforming.

8. The method of claim 1, wherein the target voice data is selected by a user from a plurality of audio avatars.

9. The method of claim 1, wherein outputting the audio signal comprises outputting the audio signal to a global positioning system application, an ebook reader, an intelligent personal assistant application, a peer-to-peer communication application, or a peer-to-group communication application.

10. A system for transforming a subject voice to a target voice, the system comprising:

a slicing module configured to receive subject voice data and target voice data;

a transform module configured to:

generate a first plurality of slice patterns from the target voice data; and generate a second plurality of slice patterns from the subject voice data;

a cluster module configured to:

identify a plurality of slice groups, each slice group comprising a plurality of the first plurality of slice patterns from the target voice data; and generate a plurality of voice patterns, each voice pattern being generated from one of the plurality of slice groups;

a substitution module configured to substitute one or more of the second plurality of slice patterns from the subject voice data with one of the plurality of voice patterns; and a generation module configured to:

generate an audio signal from the voice patterns; and output the audio signal.

11. The system of claim 10, wherein the transform module is further configured to:

parse the target voice data into a plurality of slices; and for each of the plurality of slices parsed from the target voice data:

extract frequency content of the slice;

identify a plurality of dominant frequency peaks, each peak associated with a respective frequency, intensity, and phase; and generate a slice pattern based on the plurality of dominant frequency peaks.

12. The system of claim 11, wherein the clustering module is further configured to identify clusters of the first plurality of slice patterns from the target voice data using k-means clustering or x-means clustering; wherein the clusters are based on the frequency and intensity of the dominant frequency peaks of the plurality of slices parsed from the target voice data.

13. The system of claim 12, wherein the clustering module is further configured to generate a single voice pattern for each of the identified clusters, wherein each voice pattern is based on a centroid of a respective cluster.

14. The system of claim 10, wherein the transform module is further configured to:

parse the subject voice data into a plurality of slices; and for each of the plurality of slices parsed from the subject voice data:

extract frequency content of the slice;

identify a plurality of dominant frequency peaks, each peak associated with a respective frequency, intensity, and phase; and generate a slice pattern based on the plurality of dominant frequency peaks.

15. The system of claim 10, wherein the substitution module is further configured to:

identify a voice pattern of the plurality of voice patterns that is a nearest neighbor to each respective slice pattern of the second plurality of slice patterns from the subject voice data; and substitute the identified voice patterns for each respective slice pattern of the second plurality of slice patterns from the subject voice data.

16. The system of claim 10, wherein the generation module is further configured to:

generate a plurality of slices by transforming each of the voice patterns substituted for a slice pattern form the subject voice data into a temporal domain; and concatenate the plurality of slices generated by the transforming.

17. A non-transitory computer-readable storage medium including computer program instructions that, when executed, cause a computer processor to perform operations comprising:

receiving subject voice data and target voice data;

generating a first plurality of slice patterns from the target voice data;

generating a second plurality of slice patterns from the subject voice data;

identifying a plurality of slice groups, each slice group comprising a plurality of the first plurality of slice patterns from the target voice data;

generating a plurality of voice patterns, each voice pattern being generated from one of the plurality of slice groups;

substituting one or more of the second plurality of slice patterns from the subject voice data with one of the plurality of voice patterns;

generating an audio signal from the voice patterns; and outputting the audio signal.

18. The medium of claim 17, wherein the target voice data is selected by a user from a plurality of audio avatars.

19. The medium of claim 17, wherein outputting the audio signal comprises outputting the audio signal to a global positioning system application, an ebook reader, an intelligent personal assistant application, a peer-to-peer communication application, or a peer-to-group communication application.

* * * * *